US011365654B2

(12) United States Patent
Matsunaga

(10) Patent No.: US 11,365,654 B2
(45) Date of Patent: Jun. 21, 2022

(54) VALVE TIMING ADJUSTING DEVICE

(71) Applicant: DENSO CORPORATION, Kariya (JP)

(72) Inventor: Yuki Matsunaga, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 17/404,305

(22) Filed: Aug. 17, 2021

(65) Prior Publication Data

US 2021/0372301 A1 Dec. 2, 2021

Related U.S. Application Data

(63) Continuation of application No. PCT/JP2020/003753, filed on Jan. 31, 2020.

(30) Foreign Application Priority Data

Feb. 21, 2019 (JP) ..... JP2019-028967

(51) Int. Cl.
*F01L 1/34* (2006.01)
*F01L 1/344* (2006.01)
*F01L 1/46* (2006.01)

(52) U.S. Cl.
CPC ..... *F01L 1/3442* (2013.01); *F01L 1/46* (2013.01); *F01L 2001/34483* (2013.01)

(58) Field of Classification Search
CPC . F01L 1/3442; F01L 1/46; F01L 1/022; F01L 2001/34483; F01L 2001/34456; F01L 2001/34469; F01L 2001/34479; F01L 2250/02
See application file for complete search history.

(56) References Cited

U.S. PATENT DOCUMENTS

2011/0259289 A1* 10/2011 Fujiyoshi ..... F01L 1/3442 123/90.15
2017/0002749 A1 1/2017 Sakakibara et al.
2017/0138225 A1 5/2017 Hamasaki et al.
2017/0145872 A1 5/2017 Noguchi et al.
2018/0283228 A1 10/2018 Sakakibara et al.

* cited by examiner

*Primary Examiner* — Zelalem Eshete
(74) *Attorney, Agent, or Firm* — Nixon & Vanderhye P.C.

(57) ABSTRACT

A bushing member includes: a large diameter portion which is inserted on a radially inner side of a coiled segment of an assist spring and includes a straight portion which extends in an axial direction; and a small diameter portion which is located on a radially inner side of a housing and has an outer diameter that is smaller than an outer diameter of the large diameter portion. The coiled segment includes a contact portion that contacts the straight portion at a radially inner surface of the contact portion. In an axial direction, a location of an end of the straight portion, which is located on one axial side where a driven shaft is placed, coincides with a location of an end of the contact portion located on the one axial side, or is on the one axial side of the location of the end of the contact portion.

12 Claims, 13 Drawing Sheets

VALVE TIMING ADJUSTING DEVICE

CROSS REFERENCE TO RELATED APPLICATIONS

This application is a continuation application of International Patent Application No. PCT/JP2020/003753 filed on Jan. 31, 2020, which designated the U.S. and claims the benefit of priority from Japanese Patent Application No. 2019-028967 filed on Feb. 21, 2019. The entire disclosures of all of the above applications are incorporated herein by reference.

TECHNICAL FIELD

The present disclosure relates to a valve timing adjusting device.

BACKGROUND

Previously, there is known a hydraulic valve timing adjusting device that can adjust a valve timing of intake valves or exhaust valves of an internal combustion engine. The valve timing adjusting device may have an assist spring that urges a driven rotatable body relative to a drive rotatable body in an advancing direction or a retarding direction.

SUMMARY

This section provides a general summary of the disclosure, and is not a comprehensive disclosure of its full scope or all of its features.

According to the present disclosure, there is provided a valve timing adjusting device that includes a housing, a vane rotor, an assist spring and a bushing. The housing is configured to be rotated synchronously with a drive shaft. The vane rotor is received in an inside of the housing and partitions the inside of the housing into a plurality of hydraulic chambers. The vane rotor is configured to be rotated synchronously with a driven shaft. The assist spring is configured to urge the vane rotor in an advancing direction or a retarding direction relative to the housing. The bushing member is fixed to the vane rotor. The bushing member includes a large diameter portion, which is placed on a radially inner side of a coiled segment of the assist spring, and a small diameter portion, which is placed on a radially inner side of the housing and has an outer diameter that is smaller than an outer diameter of the large diameter portion. The coiled segment includes a contact portion that is located at a radially inner surface of the coiled segment and is configured to contact a straight portion of the large diameter portion. In an axial direction, a location of an end of the straight portion, which is located on one axial side where the driven shaft is placed, coincides with a location of an end of the contact portion located on the one axial side, or is on the one axial side of the location of the end of the contact portion.

BRIEF DESCRIPTION OF DRAWINGS

The drawings described herein are for illustrative purposes only of selected embodiments and not all possible implementations, and are not intended to limit the scope of the present disclosure.

DETAILED DESCRIPTION

Figure 1:
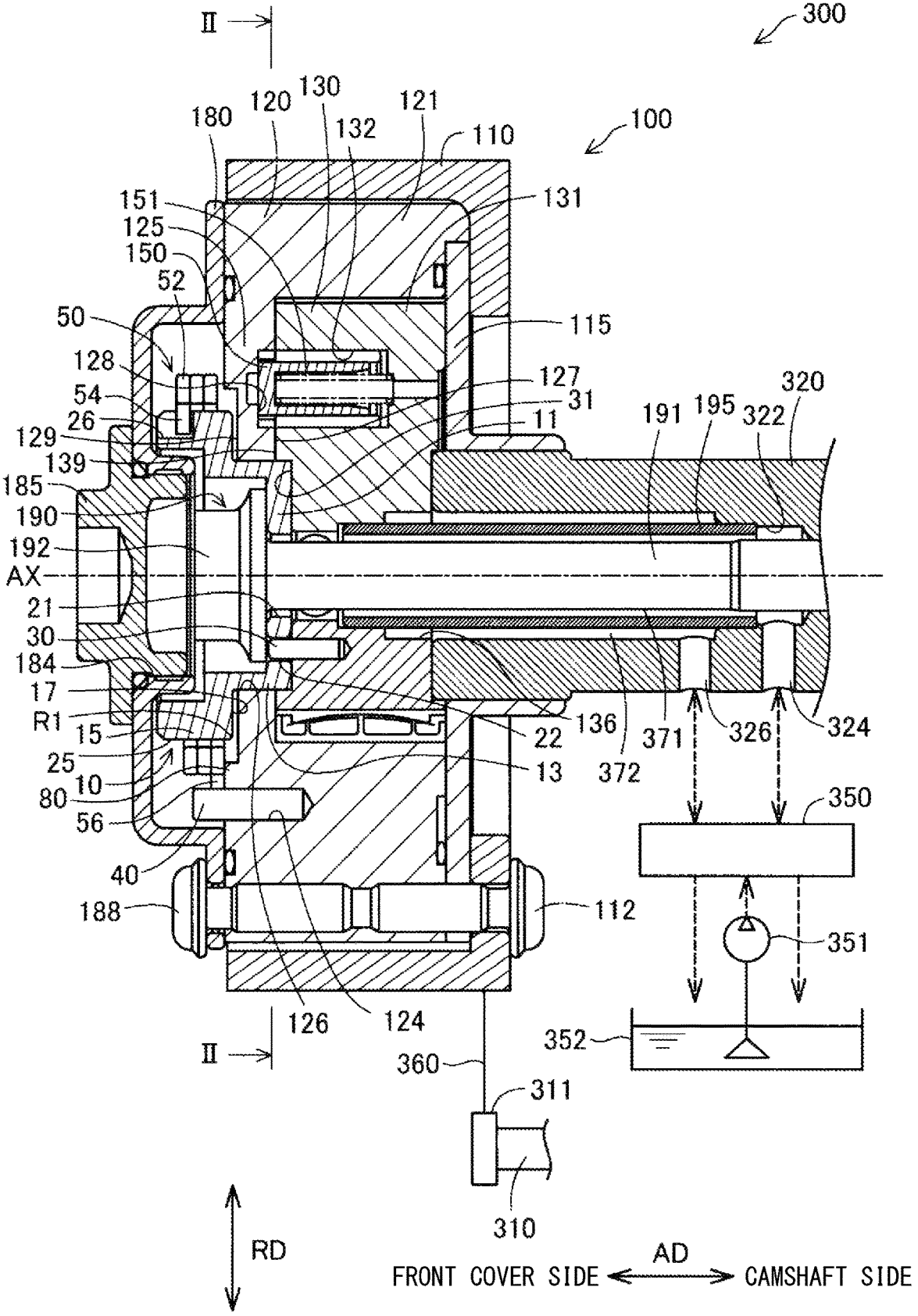
FIG. 1 is a cross-sectional view showing a schematic configuration of a valve timing adjusting device of a first embodiment.

Previously, there is known a hydraulic valve timing adjusting device that can adjust a valve timing of intake valves or exhaust valves of an internal combustion engine. The valve timing adjusting device may have an assist spring that urges a driven rotatable body relative to a drive rotatable body in an advancing direction or a retarding direction. In one previously proposed valve timing adjusting device, a bushing member, which is fixed to a vane rotor (serving as a driven rotatable body) and rotatably supports a housing (serving as a drive rotatable body), is inserted into an assist spring.

The inventor of the present application has envisioned that the bushing member described above would be formed in a stepped cylindrical tubular form. This is due to the following reason. That is, a diameter of one portion of the bushing member, which contacts the housing in the radial direction, may be reduced to increase a sealing area between the vane rotor and the housing and thereby limit leakage of hydraulic oil through a gap between the vane rotor and the housing, and a diameter of the other portion of the bushing member, which contacts the assist spring in the radial direction, may be increased to use an assist spring having a large diameter for increasing an output torque of the assist spring.

In the case where the bushing member is shaped in the stepped cylindrical tubular form, a gap needs to be formed between the bushing member and the housing at the stepped portion of the bushing member to ensure slidability between the bushing member and an axial end surface of the housing. The inventor of the present application has found that when the assist spring is placed on the outer side of this gap in the radial direction, a contact area between the assist spring and the bushing member may possibly be reduced at a part of a radially inner surface of the assist spring, which is supported by the bushing member. When the contact area is reduced, a contact pressure generated between the assist spring and the bushing member is increased to possibly cause an increase in wear between the assist spring and the bushing member. Therefore, it is desirable to have a technique that can limit the decrease in the contact area between the assist spring and the bushing member.

According to one aspect of the present disclosure, there is provided a valve timing adjusting device to be installed to an end portion of a driven shaft located at an end of the driven shaft in an axial direction, wherein the driven shaft is configured to receive a drive force transmitted from a drive shaft at an internal combustion engine, and the valve timing adjusting device is configured to use a hydraulic pressure to adjust a valve timing of a valve that is driven to open and close by the driven shaft. The valve timing adjusting device includes:

a housing that is configured to be rotated synchronously with the drive shaft;

a vane rotor that is received in an inside of the housing and partitions the inside of the housing into a plurality of hydraulic chambers, wherein the vane rotor is configured to be rotated synchronously with the driven shaft;

an assist spring that is configured to urge the vane rotor in an advancing direction or a retarding direction relative to the housing, wherein the assist spring includes:

a coiled segment;

an inner end segment which is joined to one end of the coiled segment and inwardly projects in a radial direction; and an outer end segment which is joined to another end of the coiled segment and outwardly projects in the radial direction; and a bushing member that is fixed to the vane rotor, wherein:

the bushing member is shaped in a stepped cylindrical tubular form and includes:

a large diameter portion which is shaped in a cylindrical tubular form and is placed on a radially inner side of the coiled segment, wherein the large diameter portion includes a straight portion which is located at a radially outer surface of the large diameter portion and extends in the axial direction; and a small diameter portion which is shaped in a cylindrical tubular form and is connected to the large diameter portion on one axial side of the large diameter portion where the driven shaft is placed, wherein the small diameter portion is placed on a radially inner side of the housing and has an outer diameter that is smaller than an outer diameter of the large diameter portion;

the coiled segment includes a contact portion that is located at a radially inner surface of the coiled segment and is configured to contact the straight portion; and in the axial direction, a location of an end of the straight portion, which is located on the one axial side where the driven shaft is placed, coincides with a location of an end of the contact portion located on the one axial side, or is on the one axial side of the location of the end of the contact portion.

In the valve timing adjusting device, in the axial direction, the location of the end of the straight portion, which is located on the one axial side where the driven shaft is placed, coincides with the location of the end of the contact portion located on the one axial side, or is on the one axial side of the location of the end of the contact portion. Therefore, it is possible to limit the driven shaft side end of the contact portion of the coiled segment from losing contact with the straight portion, and thereby it is possible to limit a reduction in the contact area between the assist spring and the bushing member.

The present disclosure can be implemented in various forms. For example, the present disclosure can be implemented as an internal combustion engine, which includes the valve timing adjusting device, and a manufacturing method of the valve timing adjusting device.

Hereinafter, embodiments of the present disclosure will be described with reference to the drawings.

A. First Embodiment

A valve timing adjusting device 100 of FIG. 1 is configured to adjust a valve timing of valves that are driven to open and close by a camshaft 320 that receives a drive force transmitted from a crankshaft 310 at an internal combustion engine 300 of a vehicle (not shown). The valve timing adjusting device 100 is installed in a drive force transmission path that extends from the crankshaft 310 to the camshaft 320. More specifically, the valve timing adjusting device 100 is fixed to an end portion of the camshaft 320 in a direction (hereinafter referred to as an axial direction AD) along a rotational axis AX of the camshaft 320. The rotational axis AX of the valve timing adjusting device 100 coincides with the rotational axis AX of the camshaft 320. Among intake valves and exhaust valves (not shown), which serve as valves, the valve timing adjusting device 100 of the present embodiment adjusts the valve timing of the exhaust valves.

An axial hole 322, a retard supply hole 324 and an advance supply hole 326 are formed at the end portion of the camshaft 320. The axial hole 322 extends in the axial direction AD. A center bolt 190 is inserted into the axial hole 322 through a wall member 195 which is shaped in a cylindrical tubular form as described later. The retard supply hole 324 and the advance supply hole 326 respectively extend in a radial direction RD. The radial direction RD and the axial direction AD are perpendicular to each other. Hydraulic oil is conducted through each of the retard supply hole 324 and the advance supply hole 326. The hydraulic oil is supplied to and is discharged from the retard supply hole 324 and the advance supply hole 326 through a hydraulic oil control valve 350. The hydraulic oil control valve 350 is a spool valve that is driven by a solenoid. The hydraulic oil control valve 350 controls a hydraulic pressure of the hydraulic oil to be supplied to the retard supply hole 324 and the advance supply hole 326. The operation of the hydraulic oil control valve 350 is controlled by instructions from an ECU (not shown) that controls an overall operation of the internal combustion engine 300. The hydraulic oil is supplied from an oil pump 351 to the hydraulic oil control valve 350. The oil pump 351 pumps up the hydraulic oil stored in an oil pan 352. The hydraulic oil, which is discharged through the hydraulic oil control valve 350, is drained to the oil pan 352.

The valve timing adjusting device 100 includes a sprocket 110, a rear cover 115, a housing 120, a vane rotor 130, a bushing member 10, a retainer pin 40, an assist spring 50, a front cover 180, a cap 185, the center bolt 190 and the wall member 195.

The sprocket 110 cooperates with the rear cover 115 and the housing 120 to function as a drive rotatable body that is rotated synchronously with the crankshaft 310. A timing chain 360, which is shaped in a loop form, is wound around the sprocket 110 and a sprocket portion 311 of the crankshaft 310. The sprocket 110 is fixed to the rear cover 115 and the housing 120 by a plurality of rear-side bolts 112.

The rear cover 115 is installed to an end surface of the housing 120 which is located on a side (hereinafter simply referred to as "camshaft 320 side") where the camshaft 320 is placed in the axial direction AD. The rear cover 115 slidably contacts an end surface of the vane rotor 130 located on the camshaft 320 side.

The housing 120 is shaped in a bottomed tubular form and receives the vane rotor 130. The housing 120 includes a cylindrical tubular portion 121, a bottom portion 125 and a position limiting portion 80.

Figure 2:
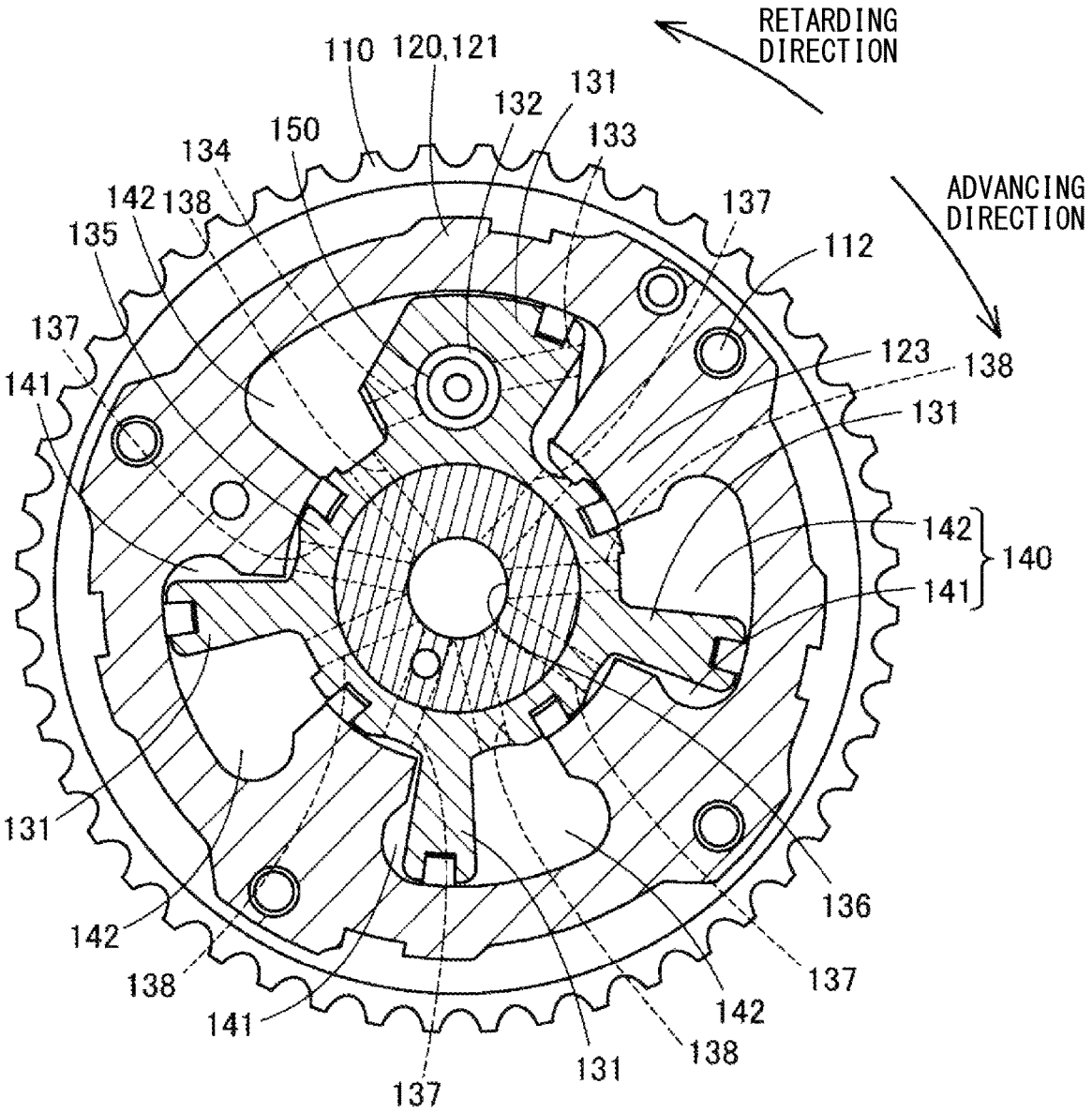
FIG. 2 is a cross-sectional view taken along line II-II in FIG. 1.

The cylindrical tubular portion 121 extends in the axial direction AD. As shown in FIG. 2, the cylindrical tubular portion 121 includes a plurality of partition walls 123 that inwardly project in the radial direction RD and are arranged one after another in the circumferential direction. A corresponding one of a plurality of vanes 131 of the vane rotor 130 described later is interposed between each circumferentially adjacent two of the partition walls 123.

As shown in FIG. 1, the bottom portion 125 extends in the radial direction RD. An opening 126 is formed at a center of the bottom portion 125. A small diameter portion 13 of the bushing member 10 described later is inserted in the opening 126. An inner surface 127 of the bottom portion 125, which is located on the camshaft 320 side, slidably contacts an end surface of the vane rotor 130 which is located on an opposite side (hereinafter simply referred to as "front cover 180 side") that is opposite to the camshaft 320 side in the axial direction AD. A fitting recess 128 is formed at the inner surface 127 at a location that corresponds to a lock pin 150 described later. An outer surface 129, which is an end surface of the bottom portion 125 located on the front cover 180 side and positioned on the inner side of the position limiting portion 80 in the radial direction RD, is slidable relative to a slide surface 17 of the bushing member 10 described later.

The position limiting portion 80 is formed at an end surface of the housing 120 located on the front cover 180 side and is positioned on an outer side of the outer surface 129 in the radial direction RD. In the present embodiment, the outer surface 129 is recessed from the position limiting portion 80 toward the camshaft 320 side so that the position limiting portion 80 projects in a ring form over the entire circumference toward the front cover 180 side. The position limiting portion 80 contacts a portion of an end surface of the assist spring 50 located on the camshaft 320 side. In this way, the position limiting portion 80 limits the position of the assist spring 50 relative to the bushing member 10 in the axial direction AD.

An insertion hole 124, which extends in the axial direction AD, is formed at the end surface of the housing 120 located on the front cover 180 side. In the present embodiment, the insertion hole 124 is formed at the position limiting portion 80. The retainer pin 40 is inserted and is secured in the insertion hole 124.

The vane rotor 130 is received in the housing 120. In a state where the vane rotor 130 is clamped between a bushing bottom portion 11 of the bushing member 10 described later and an end surface of the camshaft 320, the center bolt 190 is fastened to the end portion of the camshaft 320. Therefore, the vane rotor 130 is rotated synchronously with the camshaft 320. The vane rotor 130 is rotated in a retarding direction or an advancing direction relative to the housing 120 according to a hydraulic pressure of the hydraulic oil supplied through the hydraulic oil control valve 350. In this way, a relative rotational phase of the camshaft 320 relative to the crankshaft 310 is changed.

As shown in FIG. 2, the vane rotor 130 includes the vanes 131 and a boss 135. The vanes 131 project outward in the radial direction RD from the boss 135 placed at a center of the vane rotor 130 and are arranged one after another in the circumferential direction. Each vane 131 is received between corresponding adjacent two of the partition walls 123 in the circumferential direction and partitions a corresponding space into a retard chamber 141 and an advance chamber 142 each of which serves as a hydraulic chamber 140. The retard chamber 141 is located on one side of the vane 131 in the circumferential direction. The advance chamber 142 is located on the other side of the vane 131 in the circumferential direction. A receiving hole 132 extends in the axial direction at one of the vanes 131. The receiving hole 132 is communicated with the adjacent retard chamber 141 through a retard-chamber-side pin control oil passage 133 formed at the vane 131 and is communicated with the adjacent advance chamber 142 through an advance-chamber-side pin control oil passage 134 formed in the vane 131. The lock pin 150, which is configured to reciprocate in the axial direction AD, is placed in the receiving hole 132. The lock pin 150 limits rotation of the vane rotor 130 relative to the housing 120 and limits collision between the housing 120 and the vane rotor 130 in the circumferential direction in a state where the hydraulic pressure is insufficient. The lock pin 150 is urged by an urging spring 151 in the axial direction AD toward the fitting recess 128 that is formed at the inner surface 127 of the housing 120.

The boss 135 has an outer shape that is in a cylindrical tubular form. A through-hole 136 extends through the center of the boss 135 in the axial direction AD. An inner diameter of the through-hole 136 decreases in a stepwise manner from the camshaft 320 side to the front cover 180 side in the axial direction AD. The center bolt 190 is inserted into the through-hole 136 through the wall member 195, which is shaped in the cylindrical tubular form. A fitting portion 31 is formed at a center of the end surface 139 of the boss 135 which is located on the front cover 180 side. The bushing member 10 is fitted to the fitting portion 31. A plurality of retard oil passages 137 and a plurality of advance oil passages 138 extend through the boss 135 in the radial direction RD. Each of the retard oil passages 137 and a corresponding one of the advance oil passages 138 are arranged side-by-side in the axial direction AD. Each retard oil passage 137 communicates between a retard communication passage 371 described later and the corresponding retard chamber 141. Each advance oil passage 138 communicates between an advance communication passage 372 described later and the corresponding advance chamber 142.

Figure 3:
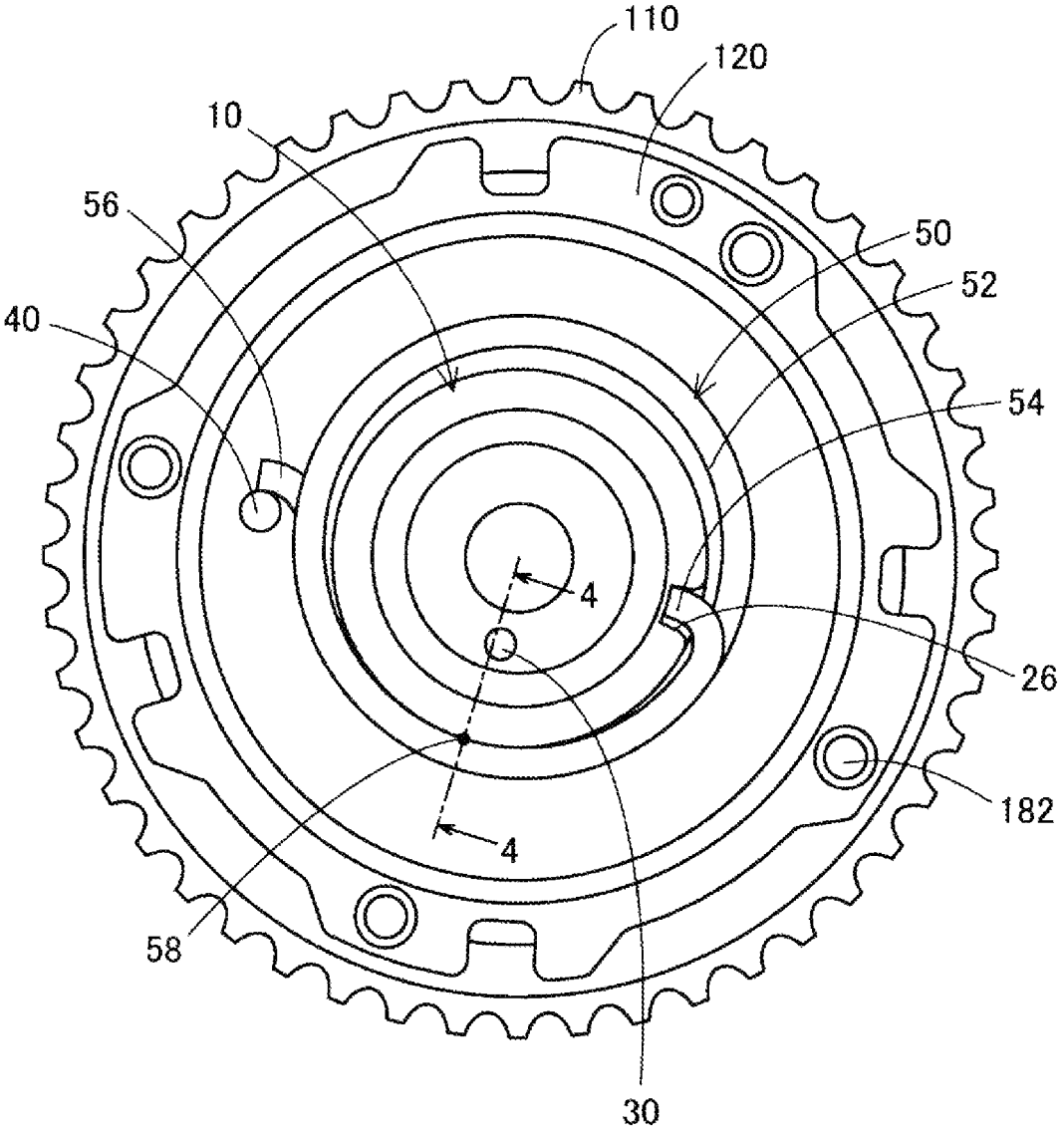
FIG. 3 is a front view of the valve timing adjusting device seen from a side that is opposite to a camshaft.

In FIG. 3, for convenience of explanation, the valve timing adjusting device 100 is indicated without the front cover 180 and the cap 185 in place. The bushing member 10 shown in FIGS. 1 and 3 is fixed to the vane rotor 130 to rotate integrally with the vane rotor 130. In the present embodiment, the bushing member 10 has a function of rotatably supporting the housing 120.

The bushing member 10 has an outer shape that is in a stepped cylindrical tubular form having a bottom. The reason why the bushing member 10 has such a configuration will be discussed later. The bushing member 10 includes the bushing bottom portion 11, the small diameter portion 13, a large diameter portion 15 and the slide surface 17.

The bushing bottom portion 11 extends in the radial direction RD and forms an end part of the bushing member 10 located on the camshaft 320 side. A bushing through-hole 21 extends through a center of the bushing bottom portion 11 in the axial direction AD. The center bolt 190 is inserted through the bushing through-hole 21. Furthermore, a pin through-hole 22 extends through the bushing bottom portion 11 in the axial direction. A fitting pin 30 is inserted through the pin through-hole 22. With this configuration, a relative position between the bushing member 10 and the vane rotor 130 in the circumferential direction is limited.

The small diameter portion 13 is joined to an outer periphery of the bushing bottom portion 11 and has an outer shape that is in a cylindrical tubular form extending in the axial direction AD. The small diameter portion 13 is inserted into the opening 126 of the bottom portion 125 of the housing 120. The small diameter portion 13 is placed on the inner side of the opening 126 of the housing 120 in the radial direction RD so that the small diameter portion 13 rotatably supports the housing 120.

The large diameter portion 15 forms an end part of the bushing member 10 located on the front cover 180 side and has an outer shape that is in a cylindrical tubular form extending in the axial direction AD. An outer diameter of the large diameter portion 15 is larger than an outer diameter of the small diameter portion 13. The large diameter portion 15 is inserted and is placed on the inner side of a coiled segment 52 of the assist spring 50 in the radial direction RD. A straight portion 25 extends in the axial direction AD at an outer surface of the large diameter portion 15 located on the outer side in the radial direction RD. As shown in FIG. 1, a retaining portion 26, which is inwardly recessed in the radial direction RD, is formed at one circumferential location of the radially outer surface of the large diameter portion 15 located on the outer side in the radial direction RD. The retaining portion 26 retains an inner end segment 54 of the assist spring 50 described later. Furthermore, the radially outer surface of the large diameter portion 15 located on the outer side in the radial direction RD contacts a contact portion 58 of the assist spring 50 described later at one circumferential location that is different from the location of the retaining portion 26.

Figure 4:
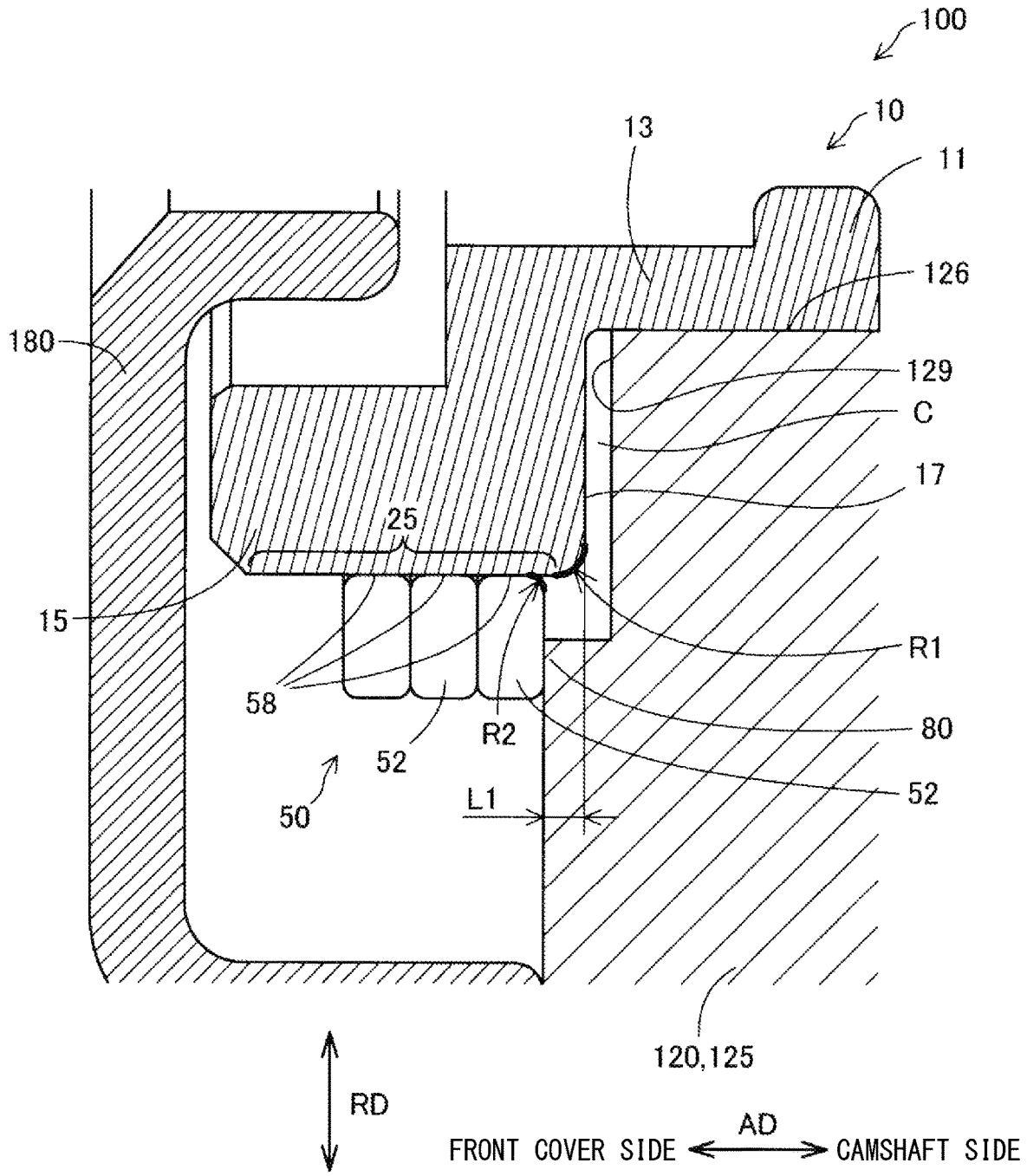
FIG. 4 is an enlarged cross-sectional view showing a portion of a cross-section taken along line 4-4 in FIG. 3.

FIG. 4 shows, in an enlarged scale, a portion of a cross-section which includes the contact portion 58 and is along the radial direction RD. As shown in FIG. 4, the slide surface 17 extends in the radial direction RD and connects between the small diameter portion 13 and the large diameter portion 15. Therefore, the small diameter portion 13 is located on the camshaft 320 side of the large diameter portion 15 in the axial direction AD and is connected to the large diameter portion 15 through the slide surface 17. The slide surface 17 is slidable relative to the outer surface 129 of the bottom portion 125 of the housing 120. Therefore, a gap C in the axial direction AD is formed between the slide surface 17 and the bottom portion 125 to ensure slidability between the slide surface 17 and the bottom portion 125. Furthermore, in the cross-section along the radial direction RD, a corner R1, which is an outer periphery of the slide surface 17 and is formed by an end part of the large diameter portion 15 located on the camshaft 320 side, has a predetermined radius of curvature. Therefore, the corner R1 does not contact the contact portion 58 of the assist spring 50. Among two opposite end parts of the straight portion 25, which are opposite to each other in the axial direction AD, the corner R1 is joined to the end part of the straight portion 25 located on the camshaft 320 side.

The retainer pin 40 shown in FIGS. 1 and 3 is inserted and is fixed in the insertion hole 124 of the housing 120. The retainer pin 40 retains an outer end segment 56 of the assist spring 50 described later.

The assist spring 50 is located on the outer side of the large diameter portion 15 of the bushing member 10 in the radial direction RD. The assist spring 50 is a torsion coil spring. In the present embodiment, the vane rotor 130 is urged by the assist spring 50 relative to the housing 120 in the advancing direction. The reason for this will be described below.

The camshaft 320 shown in FIG. 1 is rotated to open each exhaust valve against an urging force of a valve spring (not shown). Therefore, the vane rotor 130, which is rotated integrally with the camshaft 320, receives a force that is exerted by a positive torque of the camshaft 320 and urges the vane rotor 130 in a returning direction toward the retarding side. In general, the valve timing adjusting device 100, which adjusts the valve timing of the exhaust valves, is required to adjust the relative rotational phase of the camshaft 320 relative to the crankshaft 310 to a phase at the advance side at the time of starting the internal combustion engine 300. Because of this reason, the vane rotor 130 is urged by the assist spring 50 relative to the housing 120 in the advancing direction.

As shown in FIG. 3, the assist spring 50 is eccentric to the bushing member 10. The assist spring 50 includes the coiled segment 52, the inner end segment 54 and the outer end segment 56.

The coiled segment 52 shown in FIGS. 1 and 3 is formed by spirally winding a wire and has an outer shape that is in a generally cylindrical tubular form. The large diameter portion 15 is inserted and is placed on the inner side of the coiled segment 52 in the radial direction RD. As shown in FIG. 3, the coiled segment 52 includes the contact portion 58 that is formed at the radially inner surface of the coiled segment 52 located on the inner side in the radial direction RD such that the contact portion 58 is located at a part of a circumferential extent of the coiled segment 52 and are configured to contact the straight portion 25. The contact portion 58 will be described in detail later. The rest of the radially inner surface of the coiled segment 52, which is other than the contact portion 58 in the circumferential direction, does not contact the straight portion 25 of the bushing member 10.

The inner end segment 54 is connected to one end of the coiled segment 52 and is formed by bending the wire such that the inner end segment 54 inwardly projects in the radial direction RD. The inner end segment 54 is placed at and is retained by the retaining portion 26 of the bushing member 10.

The outer end segment 56 is connected to the other end of the coiled segment 52 and is formed by bending the wire such that the outer end segment 56 outwardly projects in the radial direction RD. The outer end segment 56 is placed to be hooked to and is retained by the retainer pin 40.

With the above-described configuration, the assist spring 50 is supported by the bushing member 10 and the retainer pin 40 at three circumferential locations, i.e., the inner end segment 54, the outer end segment 56 and the contact portion 58. In the present embodiment, the outer end segment 56 is located on the camshaft 320 side of the inner end segment 54 in the axial direction AD. Furthermore, in the present embodiment, the assist spring 50 is a rectangular-wire spring which is made from a wire having a rectangular cross-section. As shown in FIG. 4, a corner R2 of a cross-section of this wire is rounded and has a predetermined radius of curvature. In other words, the term "rectangular cross-section" means not only a strictly rectangular cross-section formed with pointed corners, but also a macroscopic rectangular cross-section with rounded corners. In the present embodiment, although the assist spring 50 is made from the wire having the rectangular cross-section, the assist spring 50 may be made of a wire having any polygonal cross-section, such as a hexagonal cross-section.

As shown in FIG. 1, the front cover 180 is located on the opposite side of the valve timing adjusting device 100 which is opposite to the camshaft 320 side in the axial direction AD. The front cover 180 is fixed to the housing 120 by a plurality of front-side bolts 188. An opening 184 is formed at generally the center of the front cover 180. The cap 185 is inserted into the opening 184 to close the opening 184.

The center bolt 190 is placed along the rotational axis AX of the valve timing adjusting device 100 and fixes the valve timing adjusting device 100 to the end portion of the camshaft 320. The center bolt 190 includes a shaft 191 located on the camshaft 320 side in the axial direction AD and a head 192 located on the front cover 180 side in the axial direction AD. The shaft 191 is inserted through the bushing through-hole 21 of the bushing bottom portion 11 of the bushing member 10 and the through-hole 136 of the boss 135 of the vane rotor 130 and is fixed to the axial hole 322 such that the wall member 195 is interposed on the radially outer side of the shaft 191. Therefore, the bottom portion 125 of the bushing member 10 and the vane rotor 130 are clamped between the head 192 of the center bolt 190 and the end surface of the camshaft 320. With this configuration, the vane rotor 130 and the bushing member 10 are rotated integrally with the camshaft 320.

The wall member 195 has the outer shape in the cylindrical tubular form and surrounds the shaft 191 of the center bolt 190. The wall member 195 partitions the space, which is defined between the inner peripheral surface of the axial hole 322 of the camshaft 320 and the outer peripheral surface of the shaft 191 of the center bolt 190, into the retard communication passage 371 and the advance communication passage 372 in the radial direction RD.

The hydraulic oil, which is supplied to the retard supply hole 324 through the hydraulic oil control valve 350, is supplied to the retard chambers 141 through the retard communication passage 371 and the retard oil passages 137. As a result, the vane rotor 130 undergoes relative rotation in the retarding direction relative to the housing 120, so that the rotational phase of the camshaft 320 relative to the crankshaft 310 shifts to the retard side. Furthermore, the hydraulic oil, which is supplied to the advance supply hole 326 through the hydraulic oil control valve 350, is supplied to the advance chambers 142 through the advance communication passage 372 and the advance oil passages 138. As a result, the vane rotor 130 undergoes relative rotation in the advancing direction relative to the housing 120, so that the rotational phase of the camshaft 320 relative to the crankshaft 310 shifts to the advance side. Furthermore, when the hydraulic oil is supplied to both of the retard chambers 141 and the advance chambers 142, the rotation of the vane rotor 130 relative to the housing 120 is limited so that the rotational phase of the camshaft 320 relative to the crankshaft 310 is maintained.

The hydraulic oil, which is supplied to the retard chambers 141 or the advance chambers 142, flows into the receiving hole 132 through the retard-chamber-side pin control oil passage 133 or the advance-chamber-side pin control oil passage 134. Therefore, when the sufficient hydraulic pressure is exerted in the retard chambers 141 or the advance chambers 142, the lock pin 150 is removed from the fitting recess 128 against the urging force of the urging spring 151 by the hydraulic oil supplied into the receiving hole 132. Thus, the rotation of the vane rotor 130 relative to the housing 120 is enabled.

A reason why the bushing member 10 of the present embodiment is shaped in the stepped cylindrical tubular form will be explained below. As described above, the hydraulic oil flows into the hydraulic chambers 140 formed by the vane rotor 130 and the housing 120. The hydraulic oil of the hydraulic chambers 140 may possibly leak through a gap between the end surface 139 of the boss 135 and the inner surface 127 of the housing 120. For this reason, it is desirable to ensure a large sealing area between the end surface of the boss 135 and the inner surface 127 of the housing 120. Therefore, it is conceivable to ensure the large dimension of the end surface 139 of the boss 135 measured in the radial direction RD by reducing the dimension of the fitting portion 31 of the boss 135 measured in the radial direction RD at the end surface 139 of the boss 135. Because of this reason, in the present embodiment, the outer diameter of the small diameter portion 13 of the bushing member 10, which has the function of rotatably supporting the housing 120, is reduced to enable installation of the small diameter portion 13 into the fitting portion 31 of the boss 135.

Furthermore, since the bushing member 10 supports the assist spring 50, which is eccentric to the rotational axis AX, at a part of a circumferential extent of the bushing member 10, it is desirable to design the bushing member 10 according to the inner diameter of the assist spring 50 which can ensure the required torque. Therefore, according to the present embodiment, in the bushing member 10, the outer diameter of the large diameter portion 15, which contacts the assist spring 50 in the radial direction RD, is increased in order to use the assist spring 50 having the large diameter which can ensure the large output torque of the assist spring 50.

Since the bushing member 10 is shaped in the stepped cylindrical tubular form, the gap C in the axial direction AD is required between the slide surface 17, which connects between the small diameter portion 13 and the large diameter portion 15, and the outer surface 129 of the housing 120 to ensure the slidability between the slide surface 17 and the outer surface 129 of the housing 120. Here, if the assist spring 50 is placed on the outer side of the gap C in the radial direction RD, the contact area between the assist spring 50 and the bushing member 10 may possibly be reduced at the contact portion 58 of the radially inner surface of the assist spring 50, which is supported by the bushing member 10. However, in the valve timing adjusting device 100 of the present embodiment, it is possible to limit a reduction in the contact area between the assist spring 50 and the bushing member 10 due to provision of the following configuration.

As described above, the corner R2 of the cross-section of the wire of the assist spring 50 is rounded and has the predetermined radius of curvature. Therefore, as shown in FIG. 4, at the circumferential location, at which the contact portion 58 is placed, the corner R2 of the assist spring 50 does not contact the straight portion 25 in the radial direction RD so that the corner R2 does not constitute the contact portion 58. Specifically, the contact portion 58 is formed as a part of the radially inner surface of the coiled segment 52 which contacts the straight portion 25 of the bushing member 10.

Here, a distance L1, which is measured in the axial direction AD from the end surface of the position limiting portion 80 located on the front cover 180 side to the slide surface 17 of the bushing member 10, is set to be larger than a difference between an outer perimeter length of the corner R1 of the cross-section of the bushing member 10 and an outer perimeter length of the corner R2 of the cross-section of the wire of the assist spring 50 in the cross-section along the radial direction RD. With this configuration, in the axial direction AD, the camshaft 320 side end of the straight portion 25 is located on the camshaft 320 side of the camshaft 320 side end of the contact portion 58. Here, it should be understood that the distance L1 may be set to be larger than a difference between an axial length of the corner R1 of the bushing member 10 measured in the axial direction AD and an axial length of the corner R2 of the assist spring 50 measured in the axial direction AD. In the present embodiment, at the circumferential location at which the contact portion 58 is formed, the slide surface 17 is located on the camshaft 320 side of the camshaft 320 side end surface of the assist spring 50.

Furthermore, in FIG. 4, for convenience of illustration, the position limiting portion 80 is indicated as being in contact with the camshaft 320 side end surface of the coiled segment 52 of the assist spring 50 at the circumferential location that corresponds to the circumferential location of the contact portion 58. Here, it should be understood that the position limiting portion 80 may contact at least a circumferential part of the camshaft 320 side end surface of the assist spring 50 at, for example, a circumferential location that corresponds to a circumferential location of the inner end segment 54 shown in FIG. 3 instead of the circumferential location that corresponds to the circumferential location of the contact portion 58.

In the present embodiment, the crankshaft 310 corresponds to the subordinate concept of the drive shaft of the present disclosure, and the camshaft 320 corresponds to the subordinate concept of the driven shaft of the present disclosure.

In the valve timing adjusting device 100 of the first embodiment described above, the coiled segment 52 includes the contact portion 58 that is formed at the radially inner surface of the coiled segment 52 and is configured to contact the straight portion 25, and in the axial direction AD, the camshaft 320 side end of the straight portion 25 is located on the camshaft 320 side of the camshaft 320 side end of the contact portion 58. Therefore, it is possible to limit the camshaft 320 side end of the contact portion 58 of the coiled segment 52 from losing contact with the straight portion 25 of the large diameter portion 15, and thereby it is possible to limit a reduction in the contact area between the assist spring 50 and the bushing member 10. Therefore, it is possible to limit an increase in a contact pressure generated between the assist spring 50 and the bushing member 10, and thereby it is possible to limit an increase in wear between the assist spring 50 and the bushing member 10.

Furthermore, due to the provision of the bushing member 10 shaped in the stepped cylindrical tubular form, a diameter of the small diameter portion 13, which contacts the housing 120 in the radial direction RD, can be reduced to ensure the large sealing area between the end surface 139 of the boss 135 and the inner surface 127 of the housing 120. Therefore, it is possible to limit the leakage of the hydraulic oil from the hydraulic chambers 140 through the gap between the end surface 139 of the boss 135 and the inner surface 127 of the housing 120. Furthermore, since the diameter of the large diameter portion 15, which contacts the assist spring 50 in the radial direction RD, can be increased, the assist spring 50 having the large diameter can be used. Thus, the output torque of the assist spring 50 can be increased.

Furthermore, the position limiting portion 80 formed at the housing 120 limits the position of the assist spring 50 relative to the bushing member 10 in the axial direction AD. This can limit an increase in the number of parts for limiting such a position and thus can limit the manufacturing process from becoming complicated. Furthermore, since the position limiting portion 80, which projects toward the front cover 180 side, is implemented by recessing the outer surface 129 toward the camshaft 320 side, the housing 120 can be formed by a cutting process, which limits an increase in the manufacturing costs of the housing 120.

Furthermore, since the assist spring 50 is the rectangular-wire spring, the rigidity of the assist spring 50 can be increased, and the length of the assist spring 50 in the axial direction AD can be reduced. This makes it possible to improve the mountability of the assist spring 50 and to limit an increase in the dimension of the valve timing adjusting device 100 measured in the axial direction AD.

Furthermore, since the outer end segment 56 of the assist spring 50 is located on the camshaft 320 side of the inner end segment 54 of the assist spring 50 in the axial direction AD, it is possible to limit the excessive projection of the retainer pin 40 toward the front cover 180 side, thereby limiting the deterioration in the mountability of the retainer pin 40. Therefore, it is possible to limit an increase in the dimension of the valve timing adjusting device 100 measured in the axial direction AD.

Furthermore, at the circumferential location at which the contact portion 58 is formed, the slide surface 17 of the bushing member 10 is locate on the camshaft 320 side of the camshaft 320 side end surface of the assist spring 50 in the axial direction AD so that the assist spring 50 is not placed on the outer side of the gap C in the radial direction RD. Therefore, it is possible to limit a decrease in the contact area between the assist spring 50 and the bushing member 10 at the contact portion 58 formed at the radially inner surface of the assist spring 50 and is supported by the bushing member 10. As a result, it is possible to limit the decrease in the contact area between the assist spring 50 and the bushing member 10 in comparison to the structure, in which the assist spring 50 is placed on the outer side of the gap C in the radial direction RD. Therefore, it is possible to limit an increase in a contact pressure generated between the assist spring 50 and the bushing member 10, and thereby it is possible to limit an increase in wear between the assist spring 50 and the bushing member 10.

B. Second Embodiment

Figure 5:
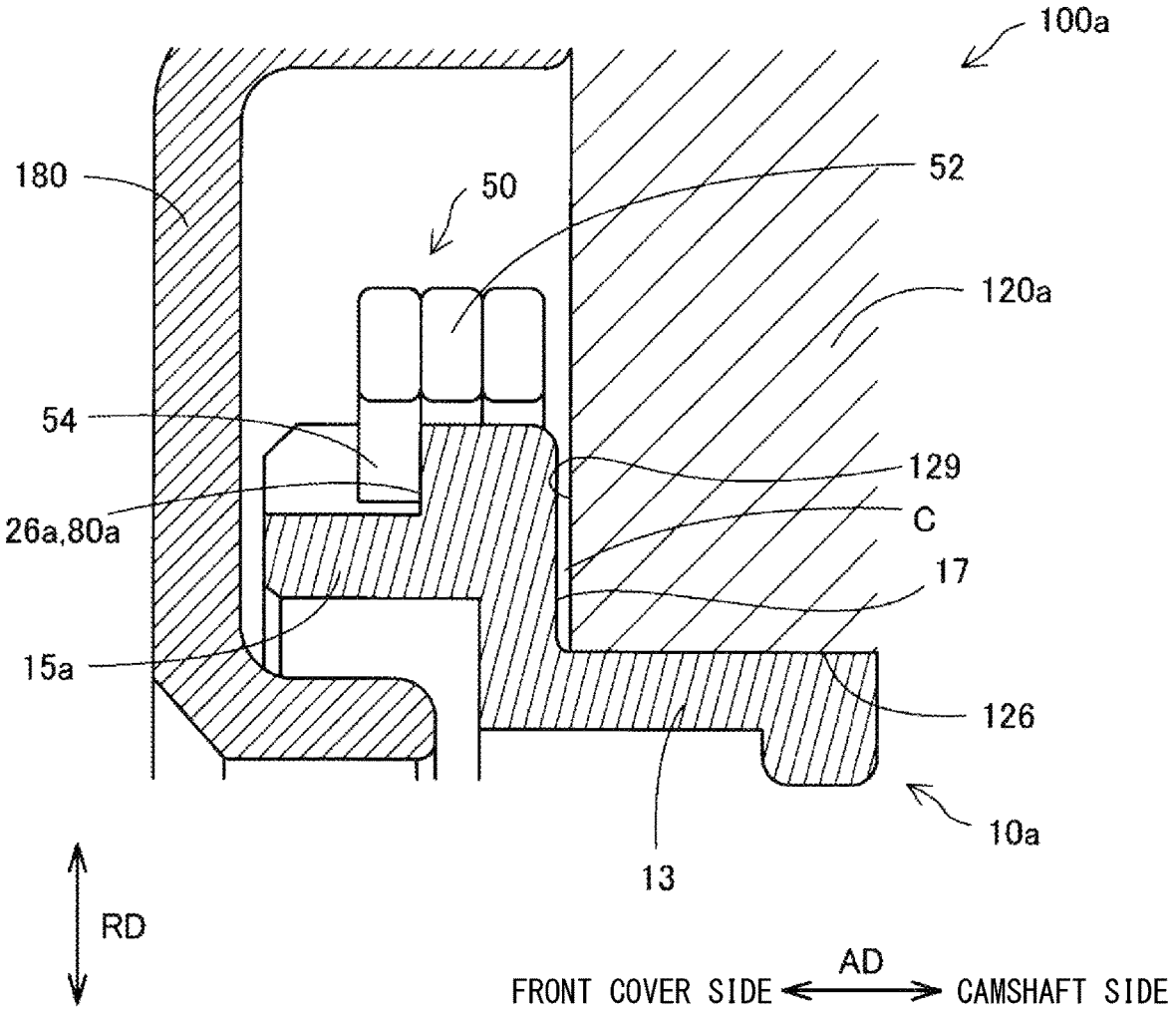
FIG. 5 is an enlarged cross-sectional view showing a schematic configuration of a valve timing adjusting device of a second embodiment.

A valve timing adjusting device **100*a* of a second embodiment shown in FIG. 5 differs from the valve timing adjusting device 100 of the first embodiment with respect to a configuration of a position limiting portion 80*a*. Specifically, the valve timing adjusting device 100*a* of the second embodiment differs from the valve timing adjusting device 100 of the first embodiment with respect to that the valve timing adjusting device 100*a* includes a housing 120*a* and a bushing member 10*a* in place of the housing 120 and the bushing member 10. Other parts are the same as in the first embodiment, so identical parts are indicated by the same reference signs and their detailed descriptions are omitted. FIG. 5 shows, in an enlarged scale, a portion of a cross-section which includes the inner end segment 54 and is similar to the cross-section shown in FIG. 1**.

The position limiting portion 80 is eliminated from the housing **120*a*. Therefore, the end surface of the housing 120*a* located on the front cover 180 side is planar. The bushing member 10*a* includes a large diameter portion 15*a* in place of the large diameter portion 15. The radially outer surface of the large diameter portion 15***a* located on the outer side in the radial direction RD has a retaining portion 26*a* that is inwardly recessed in the radial direction RD and is located at one circumferential location of the radially outer surface of the large diameter portion 15*a*. The retaining portion 26*a* of the second embodiment is formed at the location that is slightly displaced from the location of the retaining portion 26 of the first embodiment toward the front cover 180 side in the axial direction AD. With this configuration, the retaining portion 26*a* functions as the position limiting portion 80*a*, and the retaining portion 26*a* retains the inner end segment 54 of the assist spring 50 and contacts the camshaft 320 side end surface of the inner end segment 54. Specifically, the retaining portion 26*a* also has the function of the position limiting portion 80*a*. Even in the present embodiment, the camshaft 320 side end of the straight portion (not shown in FIG. 5) is located on the camshaft 320 side of the camshaft 320 side end of the contact portion (not shown in FIG. 5) in the axial direction AD.

The valve timing adjusting device 100*a* of the second embodiment described above can achieve the advantages which are similar to those of the valve timing adjusting device 100 of the first embodiment. In addition, since the position limiting portion 80*a* of the retaining portion 26*a* of the bushing member 10*a* also has the function of the position limiting portion 80*a*, it is possible to limit an increase in the number of parts, and thereby it is possible to limit the manufacturing process from becoming complicated.

C. Third Embodiment

Figure 6:
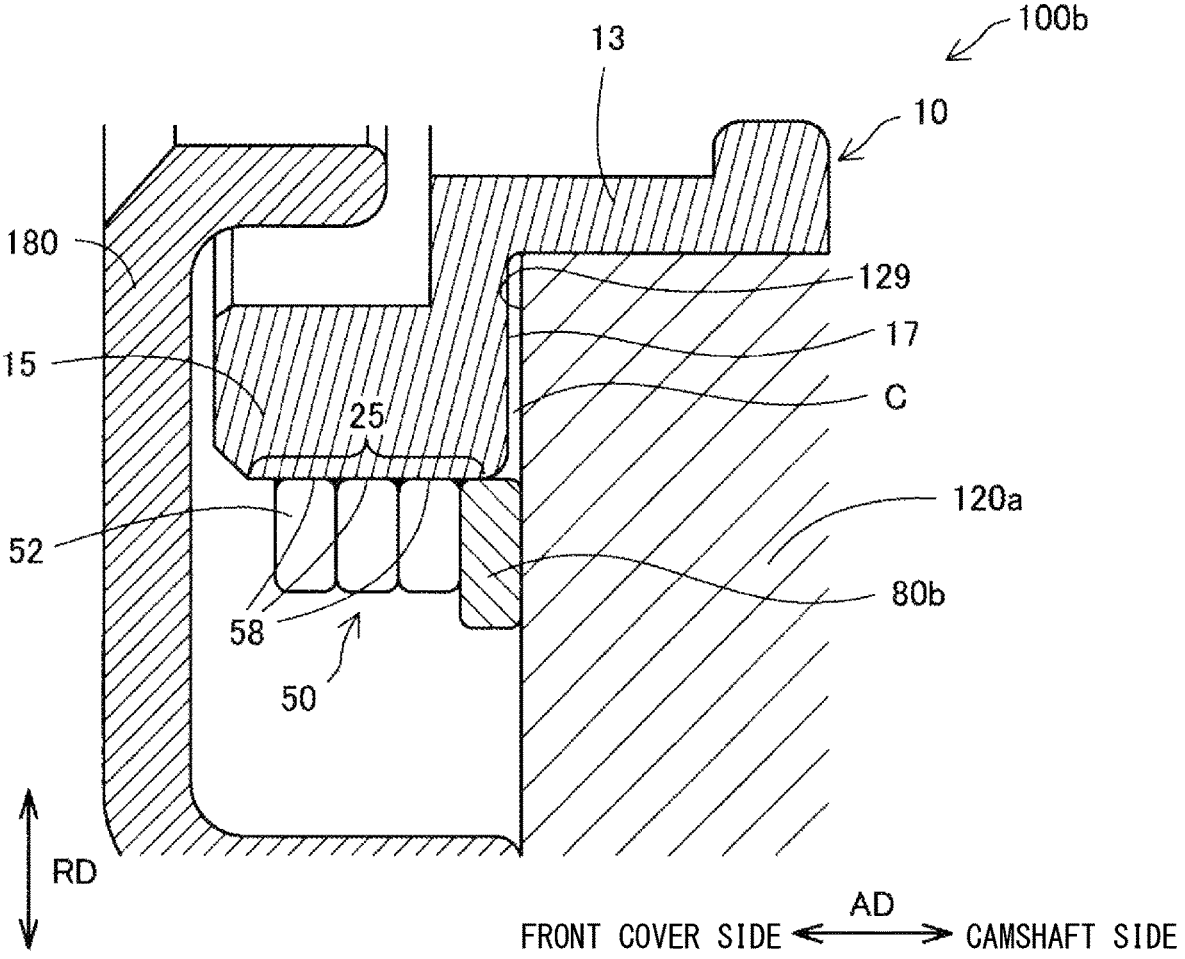
FIG. 6 is an enlarged cross-sectional view showing a schematic configuration of a valve timing adjusting device of a third embodiment.

A valve timing adjusting device 100*b* of a third embodiment shown in FIG. 6 differs from the valve timing adjusting device 100 of the first embodiment with respect to a configuration of a position limiting portion 80*b*. Specifically, the valve timing adjusting device 100*b* of the third embodiment differs from the valve timing adjusting device 100 of the first embodiment with respect to that the valve timing adjusting device 100*b* includes the housing 120*a*, which is similar to the housing 120*a* of the second embodiment, in place of the housing 120 and further includes an intervening member 80*b* which has the function of the position limiting portion 80*b*. Other parts are the same as in the first embodiment, so identical parts are indicated by the same reference signs and their detailed descriptions are omitted. FIG. 6 shows, in an enlarged scale, a portion of a cross-section which includes the contact portion 58 like in FIG. 4.

The position limiting portion 80 is eliminated from the housing 120*a*. Therefore, the end surface of the housing 120*a* located on the front cover 180 side is planar. In the present embodiment, the intervening member 80*b* is a washer that has an outer shape in a ring form. An inner diameter of the intervening member 80*b* is generally the same as the inner diameter of the coiled segment 52 of the assist spring 50. One surface of the intervening member 80*b* located on the one side in the axial direction AD contacts the housing 120, and the other surface of the intervening member 80*b* located on the other side in the axial direction AD contacts the camshaft 320 side end surface of the assist spring 50 in the axial direction AD. In FIG. 6, for convenience of illustration, it is indicated that the intervening member 80*b* contacts the camshaft 320 side end surface of the assist spring 50 at the circumferential location that corresponds to the circumferential location of the contact portion 58. However, the intervening member 80*b* may contact at least a circumferential part of the camshaft 320 side end surface of the assist spring 50 at, for example, a circumferential location that corresponds to the circumferential location of the inner end segment (not shown in FIG. 6) of the assist spring 50 instead of the circumferential location that corresponds to the circumferential location of the contact portion 58. Furthermore, the intervening member 80*b* should not be limited to the washer and may be any member, such as a collar shaped in a cylindrical tubular form, which can be interposed between the housing 120*a* and the assist spring 50.

The valve timing adjusting device 100*b* of the third embodiment described above can achieve the advantages which are similar to those of the valve timing adjusting device 100 of the first embodiment. In addition, the position of the assist spring 50 relative to the bushing member 10 in the axial direction AD is limited by the intervening member 80*b*, which also has the function of the position limiting portion 80*b*, so that the configuration for limiting the position of the assist spring 50 relative to the bushing member 10 in the axial direction AD can be simplified.

D. Fourth Embodiment

Figure 7:
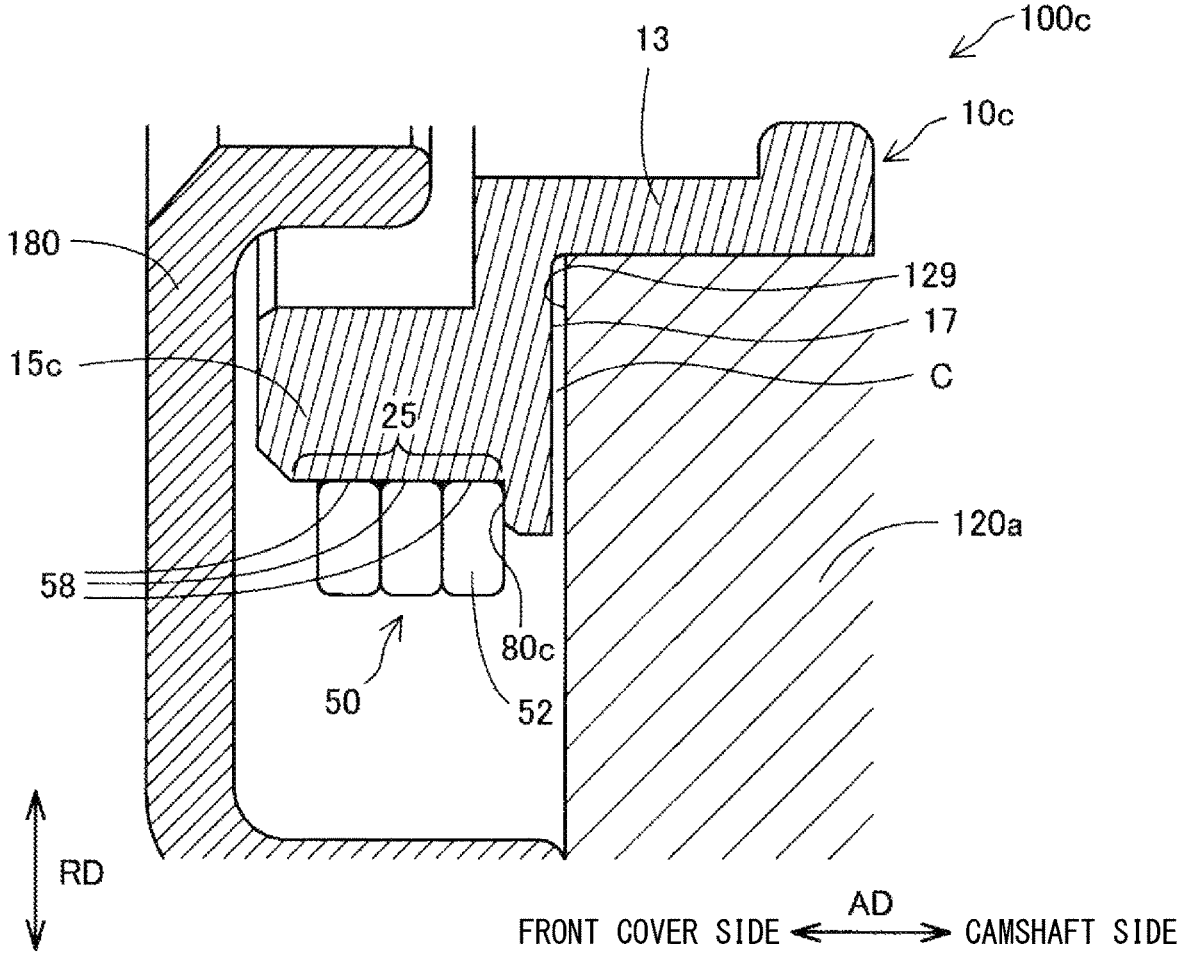
FIG. 7 is an enlarged cross-sectional view showing a schematic configuration of a valve timing adjusting device of a fourth embodiment.

A valve timing adjusting device 100*c* of a fourth embodiment shown in FIG. 7 differs from the valve timing adjusting device 100*a* of the second embodiment with respect to a configuration of a position limiting portion 80*c*. Specifically, the valve timing adjusting device 100*c* of the third embodiment differs from the valve timing adjusting device 100*a* of the second embodiment with respect to that the valve timing adjusting device 100*c* includes a bushing member 10*c* in place of the bushing member 10*a*. Other parts are the same as in the second embodiment, so identical parts are indicated by the same reference signs and their detailed descriptions are omitted. FIG. 7 shows, in an enlarged scale, a portion of a cross-section which includes the contact portion 58 like in FIG. 4.

The bushing member 10*c* includes a large diameter portion 15*c* in place of the large diameter portion 15*a*. A position limiting portion 80*c*, which outwardly projects in the radial direction RD, is formed at the end part of the large diameter portion 15*c* located on the camshaft 320 side in the axial direction AD. The position limiting portion 80*c* contacts a portion of an end surface of the assist spring 50 located on the camshaft 320 side in the axial direction AD. In the present embodiment, the position limiting portion 80*c* is formed to outwardly project in the radial direction RD and extend all around the large diameter portion 15*c* in the circumferential direction. Alternatively, the position limiting portion 80*c* may be formed along at least a part of the circumferential extent of the large diameter portion 15*c*. Furthermore, in FIG. 7, for convenience of illustration, it is indicated that the position limiting portion 80*c* contacts the camshaft 320 side end surface of the assist spring 50 at the circumferential location that corresponds to the circumferential location of the contact portion 58. However, the position limiting portion 80*c* may contact at least a circumferential part of the camshaft 320 side end surface of the assist spring 50 at, for example, a circumferential location that corresponds to the circumferential location of the inner end segment (not shown in FIG. 7) of the assist spring 50 instead of the circumferential location that corresponds to the circumferential location of the contact portion 58.

The valve timing adjusting device 100*c* of the fourth embodiment described above can achieve the advantages which are similar to those of the valve timing adjusting device 100*a* of the second embodiment.

E. Fifth Embodiment

Figure 8:
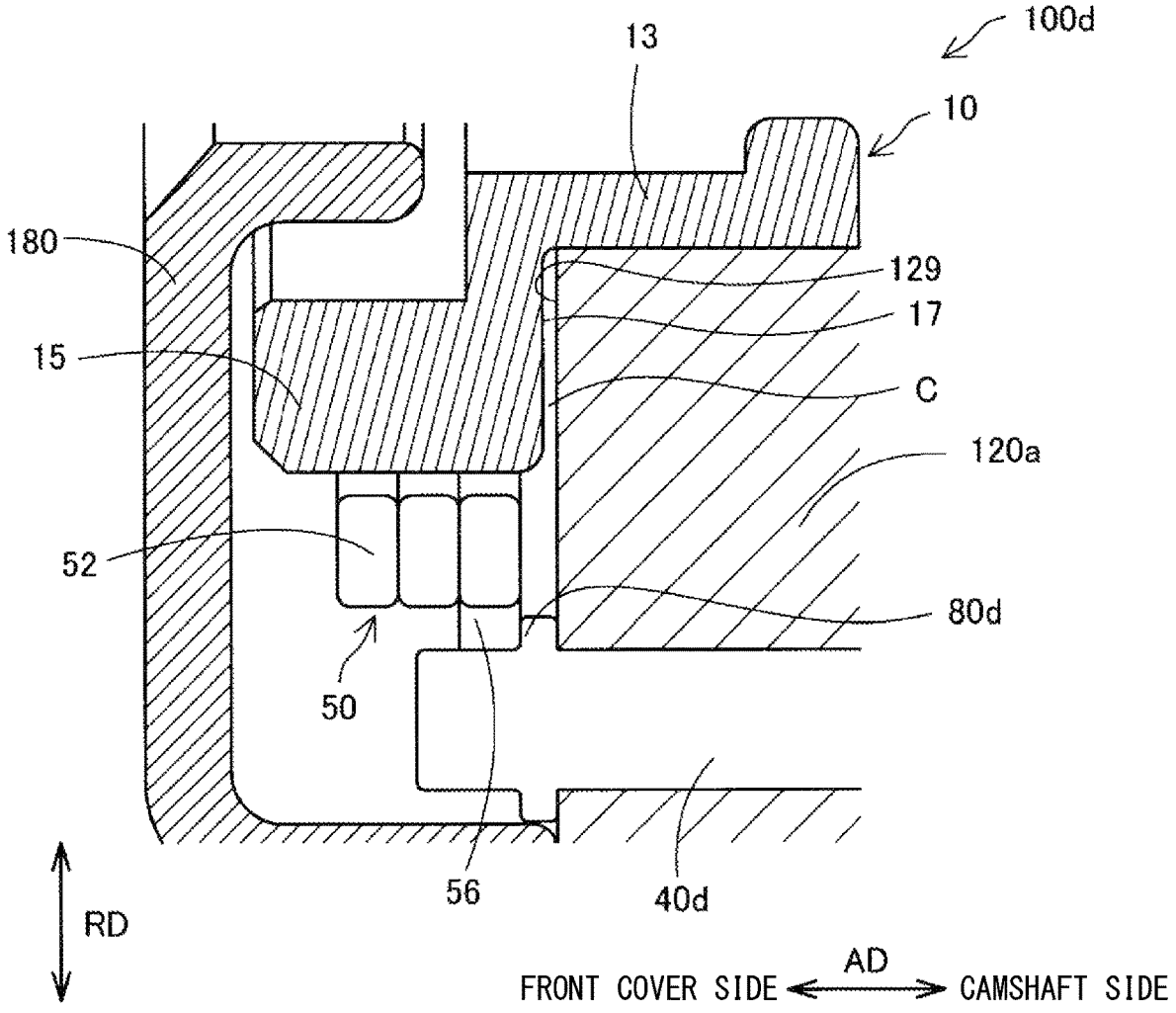
FIG. 8 is an enlarged cross-sectional view showing a schematic configuration of a valve timing adjusting device of a fifth embodiment.

A valve timing adjusting device 100*d* of a fifth embodiment shown in FIG. 8 differs from the valve timing adjusting device 100 of the first embodiment with respect to a configuration of a position limiting portion 80*d*. Specifically, the valve timing adjusting device 100*d* of the fifth embodiment differs from the valve timing adjusting device 100 of the first embodiment with respect to that the valve timing adjusting device 100*d* includes the housing 120*a*, which is similar to the housing 120*a* of the second embodiment, in place of the housing 120 and further includes a retainer pin 40*d* in place of the retainer pin 40. Other parts are the same as in the first embodiment, so identical parts are indicated by the same reference signs and their detailed descriptions are omitted. FIG. 8 shows, in an enlarged scale, a portion of a cross-section which includes the outer end segment 56 and is similar to the cross-section shown in FIG. 1.

The retainer pin 40*d* includes an enlarged diameter portion 80*d*. The enlarged diameter portion 80*d* has a diameter that is larger than a diameter of the rest of the retainer pin 40*d*. With this configuration, the enlarged diameter portion 80*d* functions as the position limiting portion 80*d* and contacts the camshaft 320 side end surface of the outer end segment 56 in the axial direction AD. Specifically, the retainer pin 40*d* has the function of retaining the outer end segment 56 of the assist spring 50 and the function of the position limiting portion 80*d*. The enlarged diameter portion 80*d* does not necessarily contact the outer end segment 56 and may contact the camshaft 320 side end surface of the coiled segment 52 in the axial direction AD. In the present embodiment, the enlarged diameter portion 80*d* extends all around the retainer pin 40*d*. Alternatively, the enlarged diameter portion 80*d* may be formed at only a part of the circumferential extent of the retainer pin 40*d* such that the enlarged diameter portion 80*d* is formed at least on the inner side of the retainer pin 40*d* in the radial direction RD of the valve timing adjusting device 100*d*. Even in the present embodiment, the camshaft 320 side end of the straight portion (not shown in FIG. 8) is located on the camshaft 320 side of the camshaft 320 side end of the contact portion (not shown in FIG. 8) in the axial direction AD.

The valve timing adjusting device 100*d* of the fifth embodiment described above can achieve the advantages which are similar to those of the valve timing adjusting device 100 of the first embodiment. In addition, since the enlarged diameter portion 80*d*, which has the function of the position limiting portion 80*d*, is formed at the retainer pin 40*d*, it is possible to limit an increase in the number of parts, and thereby it is possible to limit the manufacturing process from becoming complicated.

F. Sixth Embodiment

Figure 9:
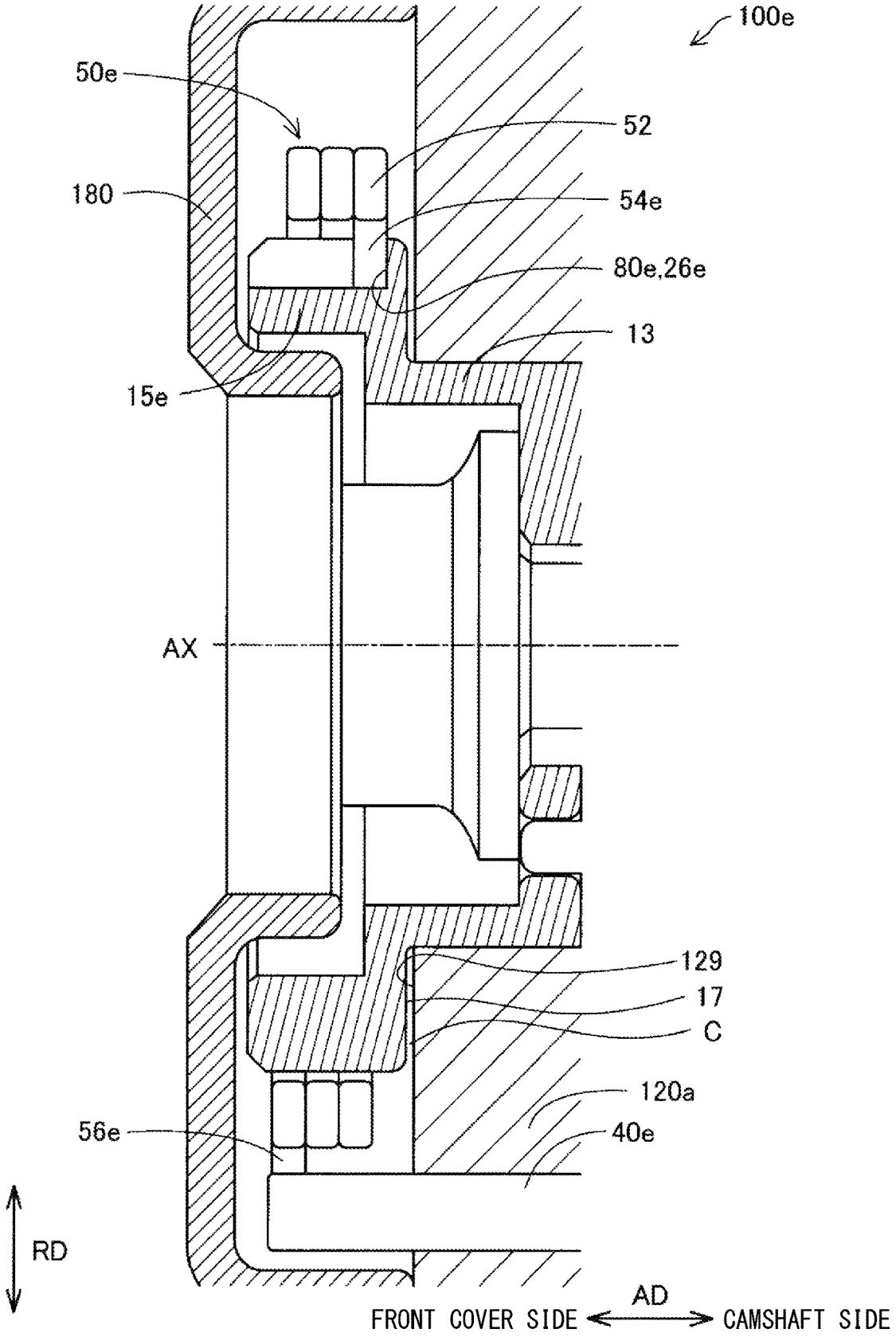
FIG. 9 is an enlarged cross-sectional view showing a schematic configuration of a valve timing adjusting device of a sixth embodiment.

A valve timing adjusting device 100*e* of a sixth embodiment shown in FIG. 9 differs from the valve timing adjusting device 100*a* of the second embodiment with respect to a configuration of a position limiting portion 80*e* and an orientation of an assist spring 50*e*. Specifically, the valve timing adjusting device 100*e* of the sixth embodiment differs from the valve timing adjusting device 100*a* of the second embodiment with respect to that the valve timing adjusting device 100*e* includes a bushing member 10*e*, the assist spring 50*e* and a retainer pin 40*e* in place of the bushing member 10*a*, the assist spring 50 and the retainer pin 40. Other parts are the same as in the second embodiment, so identical parts are indicated by the same reference signs and their detailed descriptions are omitted. FIG. 9 shows, in an enlarged scale, a portion of a cross-section which is similar to the cross-section shown in FIG. 1.

The bushing member 10*e* includes a large diameter portion 15*e* in place of the large diameter portion 15*a*. The radially outer surface of the large diameter portion 15*e* located on the outer side in the radial direction RD has a retaining portion 26*e* that is inwardly recessed in the radial direction RD and is located at one circumferential location of the radially outer surface of the large diameter portion 15*e*. The retaining portion 26*e* of the sixth embodiment is formed at a location that is on the camshaft 320 side of the location of the retaining portion 26*a* of the second embodiment in the axial direction AD. With this configuration, the retaining portion 26*e* functions as the position limiting portion 80*e*, and the retaining portion 26*e* retains an inner end segment 54*e* of the assist spring 50 and contacts an end surface of the inner end segment 54*e* located on the camshaft 320 side in the axial direction AD. Specifically, the retaining portion 26*e* also has the function of the position limiting portion 80*e*.

The assist spring 50*e* is arranged by reversing the left side and the right side of the assist spring 50 of the second embodiment in the axial direction AD. Therefore, the inner end segment 54*e* of the assist spring 50*e* is located on the camshaft 320 side of an outer end segment 56*e* in the axial direction AD. A dimension of the retainer pin 40*e* measured in the axial direction AD is increased in comparison to a dimension of the retainer pin 40 of the second embodiment measured in the axial direction AD, and the retainer pin 40*e* retains the outer end segment 56*e* of the assist spring 50*e*. Even in the present embodiment, the camshaft 320 side end of the straight portion (not shown in FIG. 9) is located on the camshaft 320 side of the camshaft 320 side end of the contact portion (not shown in FIG. 9) in the axial direction AD.

The valve timing adjusting device 100*e* of the sixth embodiment described above can achieve the advantages which are similar to those of the valve timing adjusting device 100*a* of the second embodiment. In addition, since the inner end segment 54*e* of the assist spring 50*e* is located on the camshaft 320 side of the outer end segment 56*e* in the axial direction AD, it is possible to limit an excess increase in the depth of the insertion hole 124 hole which is formed at the housing 120*a* and receives the retainer pin 40*e*.

G. Seventh Embodiment

Figure 10:
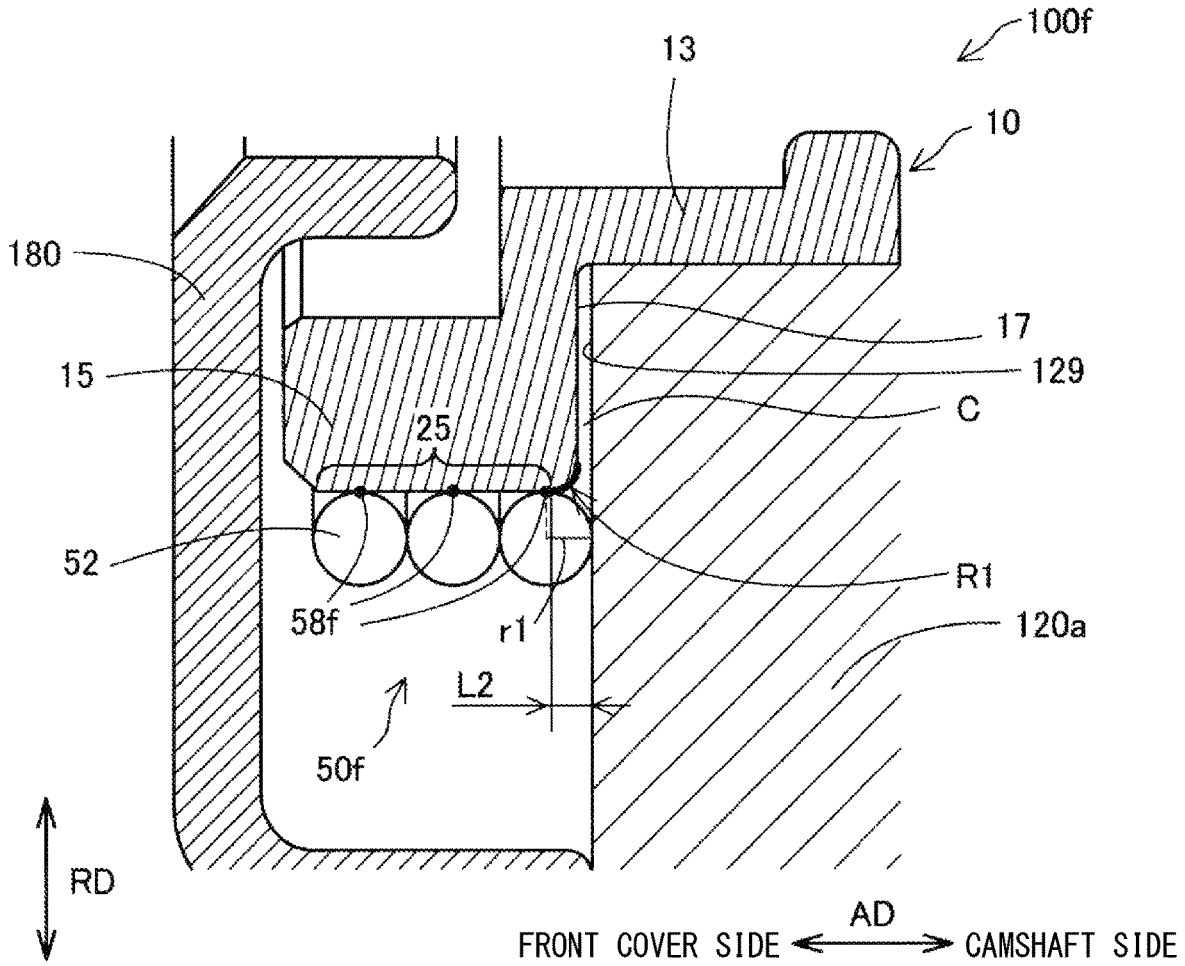
FIG. 10 is an enlarged cross-sectional view showing a schematic configuration of a valve timing adjusting device of a seventh embodiment.

A valve timing adjusting device 100*f* of a seventh embodiment shown in FIG. 10 differs from the valve timing adjusting device 100 of the first embodiment with respect to elimination of the position limiting portion 80 and provision of an assist spring 50*f* in place of the assist spring 50. Other parts are the same as in the first embodiment, so identical parts are indicated by the same reference signs and their detailed descriptions are omitted. FIG. 10 shows, in an enlarged scale, a portion of a cross-section which includes a contact portion 58*f* like in FIG. 4.

The valve timing adjusting device 100*f* of the seventh embodiment includes the housing 120*a*, which is similar to the housing 120*a* of the second embodiment, in place of the housing 120. Therefore, the position limiting portion 80 is eliminated.

The assist spring 50*f* is a round-wire spring which is made from a wire having a circular cross-section. Therefore, the contact portion 58*f* of the assist spring 50*f* is intermittently formed at the radially inner surface of the assist spring 50*f*. In the present embodiment, a radius r1 of the wire of the round-wire spring is set to be larger than a sum of a length of the corner R1 of the bushing member 10 measured in the axial direction AD and a length of the gap C between the slide surface 17 and the outer surface 129 of the housing 120*a* measured in the axial direction AD. In other words, the radius r1 of the wire of the round-wire spring is set to be larger than a dimension L2 measured in the axial direction AD between the end (camshaft 320 side end) of the straight portion 25, which is located on the camshaft 320 side, and the housing 120*a*. With the above configuration, the camshaft 320 side end of the straight portion 25 is located on the camshaft 320 side of the camshaft 320 side end of the contact portion 58*f* in the axial direction AD.

The valve timing adjusting device 100*f* of the seventh embodiment described above can achieve the advantages which are similar to those of the valve timing adjusting device 100 of the first embodiment. In addition, since the position limiting portion 80 is eliminated, the complication of the configuration of the valve timing adjusting device 100*f* can be limited, and an increase in the manufacturing costs can be limited. Furthermore, since the assist spring 50*f* is the round-wire spring, a spring constant of the assist spring 50*f* can be reduced, and thereby the assist spring 50*f* can be used within a suitable torque range. Furthermore, since the assist spring 50*f* is the round-wire spring, it is possible to limit an increase in the costs required for the assist spring 50*f*.

Figure 11:
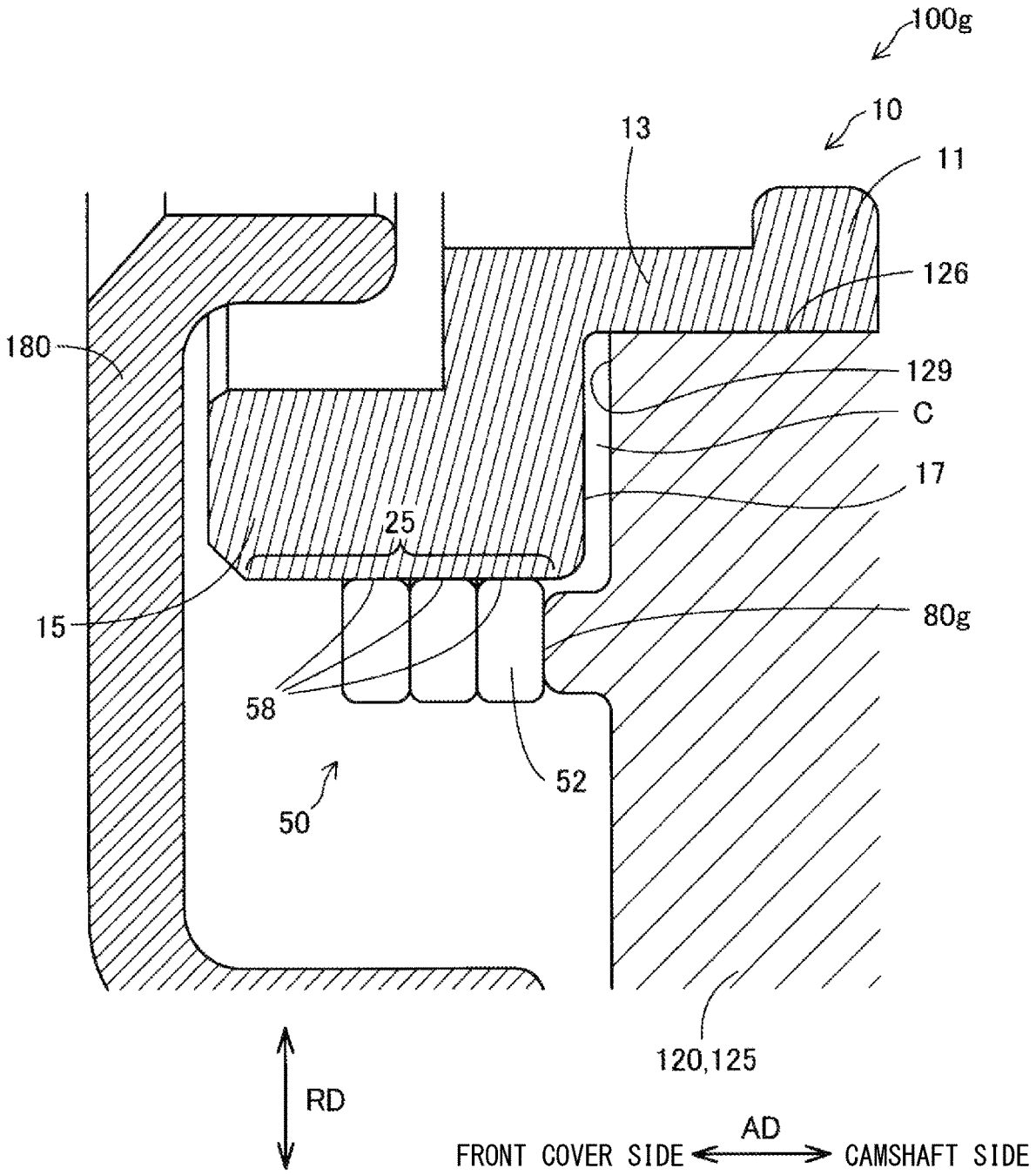
FIG. 11 is an enlarged cross-sectional view showing a schematic configuration of a valve timing adjusting device of another other embodiment 1.
Figure 12:
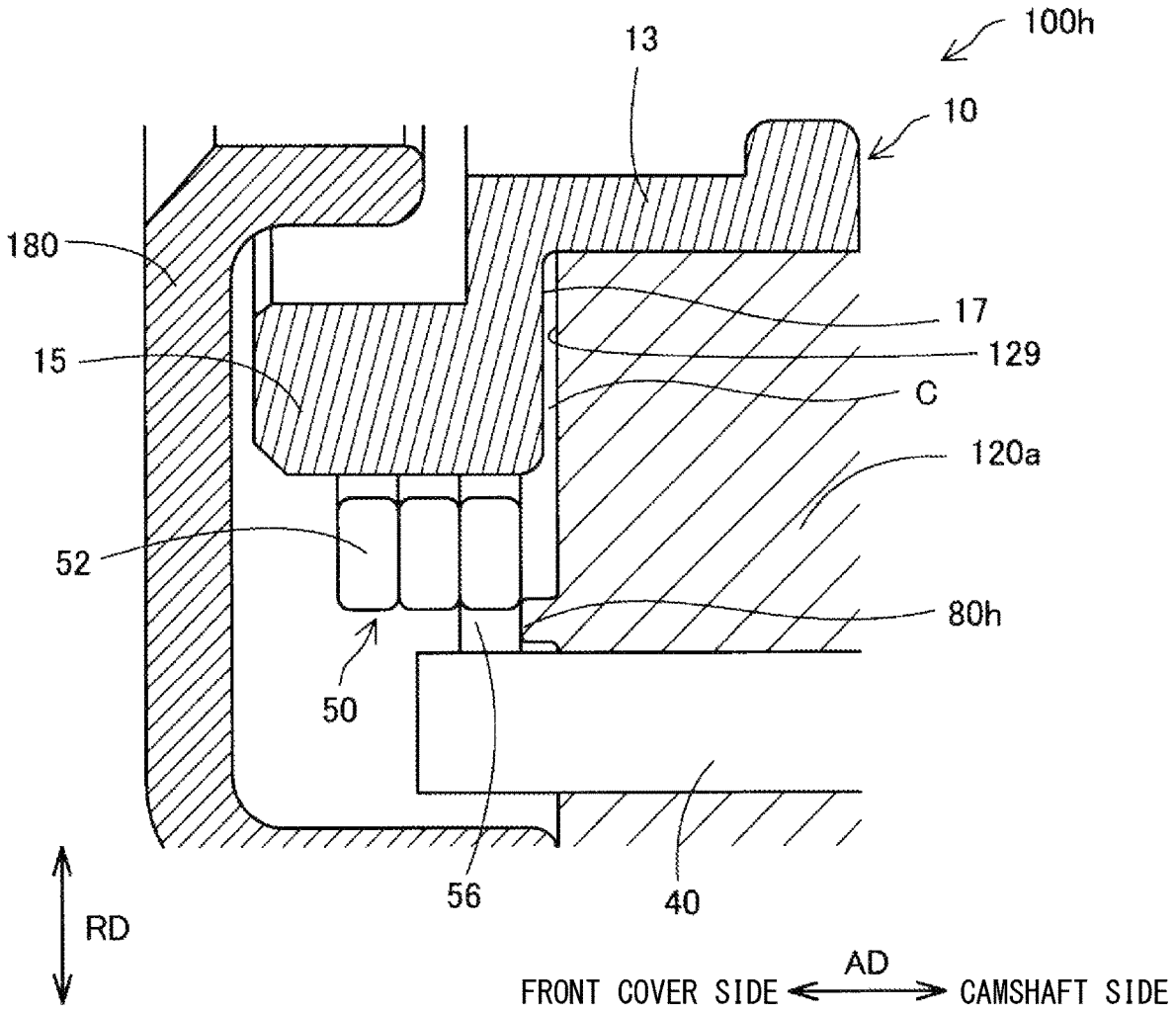
FIG. 12 is an enlarged cross-sectional view showing a schematic configuration of a valve timing adjusting device of the other embodiment 1.

H. Other Embodiments (1) The configuration of the position limiting portion 80 of the first embodiment is only an example and can be changed in various ways. For example, the position limiting portion 80 is formed by recessing the outer surface 129 relative to the position limiting portion 80 toward the camshaft 320 side so that the position limiting portion 80 projects in the ring form over the entire circumference toward the front cover 180 side. Alternatively, as in a valve timing adjusting device 100*g* shown in FIG. 11, the position limiting portion 80 may be formed as a position limiting portion 80*g* that projects in a ring form only at a location that is the same as the location of the assist spring 50 in the radial direction RD. Furthermore, for example, the position limiting portion 80 does not necessarily project over the entire circumference toward the front cover 180 side and may project from at least a part of the entire circumference of a circle toward the front cover 180 side. Furthermore, for example, the position limiting portion 80 may be formed according to the shape of the camshaft 320 side end surface of the assist spring 50 and contact the camshaft 320 side end surface of the assist spring 50 in the axial direction AD along the entire circumferential extent of the camshaft 320 side end surface of the assist spring 50. Furthermore, the position limiting portion 80 is not necessarily formed to contact the camshaft 320 side end surface of the coiled segment 52. For example, as in a valve timing adjusting device 100*h* shown in FIG. 12, the position limiting portion 80 may be formed as a position limiting portion 80*h* that projects from the housing 120 toward the front cover 180 side such that the position limiting portion 80*h* contacts the camshaft 320 side end surface of the outer end segment 56. Specifically, in general, the position limiting portion 80 may be formed to project in the axial direction AD from the housing 120 toward the opposite side, which is opposite to the camshaft 320 side in the axial direction AD, such that the position limiting portion 80 contacts at least a part of the camshaft 320 side end surface of the assist spring 50. Even with this configuration, the advantages, which are similar to those of the first embodiment, can be achieved.

(2) In the first, and third to fifth embodiments, the assist spring 50 is arranged such that the outer end segment 56 is placed on the camshaft 320 side of the inner end segment 54 in the axial direction AD. However, even in the first, and third to fifth embodiments, like the assist spring 50*e* of the sixth embodiment described above, the inner end segment 54*e* may be placed on the camshaft 320 side of the outer end segment 56*e* in the axial direction AD. Even with this configuration, the advantages, which are similar to those of the first, and third to fifth embodiments, can be achieved.

(3) in the first to sixth embodiments, the assist spring 50 is the rectangular-wire spring made from the wire having the rectangular cross-section. Alternatively, the assist spring 50 may be a round-wire spring made from a wire having a circular cross-section. Even with this configuration, the advantages, which are similar to those of the first to sixth embodiments, can be achieved.

(4) In the first to sixth embodiments, the camshaft 320 side end of the straight portion 25 is located on the camshaft 320 side of the camshaft 320 side end of the contact portion 58, 58*f* in the axial direction AD. Alternatively, the location of the camshaft 320 side end of the straight portion 25 may coincide with the location of the camshaft 320 side end of the contact portion 58, 58*f* in the axial direction AD. Specifically, in general, in the axial direction AD, the location of the driven shaft 320 side end of the straight portion 25 may coincide with the location of the driven shaft 320 side end of the contact portion 58, 58*f*, or may be on the driven shaft 320 side of the location of the driven shaft 320 side end of the contact portion 58, 58*f*. Even with this configuration, the advantages, which are similar to those of the first to sixth embodiments, can be achieved.

Figure 13:
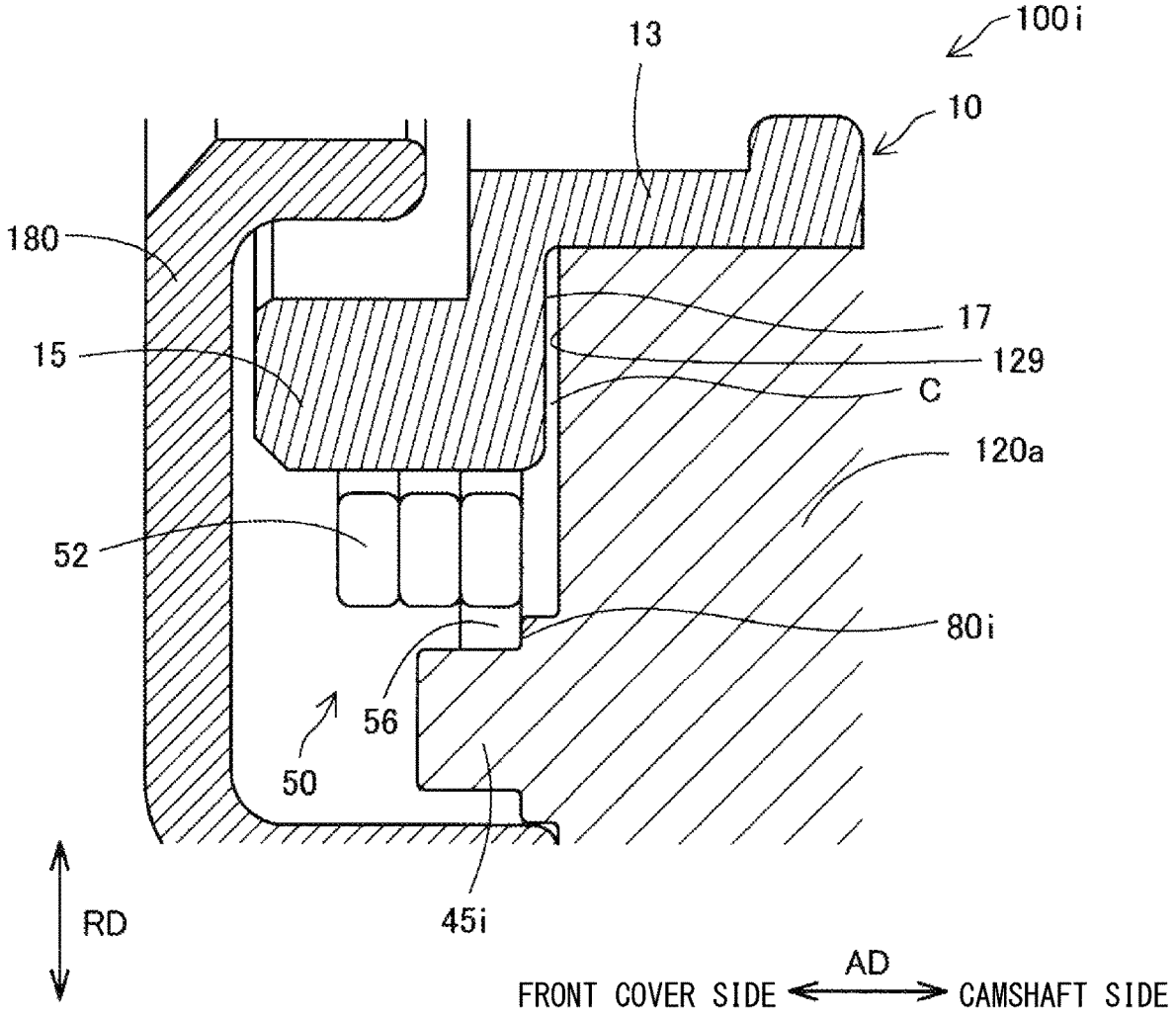
FIG. 13 is an enlarged cross-sectional view showing a schematic configuration of a valve timing adjusting device of another embodiment 5.

(5) The valve timing adjusting device 100, 100*a*-100*f* of each of the above embodiments includes the retainer pin 40, 40*d*, 40*e*. Alternatively, the retainer pin 40, 40*d*, 40*e* may be eliminated, and a projection, which has an outer shape similar to the outer shape of the retainer pin 40, 40*d*, 40*e*, may be formed integrally with the housing 120, 120*a* in one-piece. This projection retains the outer end segment 56 of the assist spring 50. In this modification, the number of parts can be reduced, and a processing step for processing the insertion hole 124 can be eliminated. Furthermore, in this modification, as in a valve timing adjusting device 100*i* shown in FIG. 13, a projection 45*i*, which has an outer shape that is similar to the outer shape of the retainer pin 40*d* of the valve timing adjusting device 100*d* of the fifth embodiment, may be formed integrally with the housing 120*a* in one-piece. The projection 45*i* includes an enlarged diameter portion 80*i* that has an outer diameter which is larger than a diameter of the rest of the projection 45*i*. The enlarged diameter portion 80*i* functions as a position limiting portion 80*i* and contacts the camshaft 320 side end surface of the outer end segment 56. Furthermore, like in the sixth embodiment, the assist spring 50*e*, in which the inner end segment 54*e* is located on the camshaft 320 side of the outer end segment 56*e* in the axial direction AD, may be used. Specifically, the projection 45*i*, which is formed integrally with the housing 120*a* in one-piece, may have the function of retaining the outer end segment 56, 56*e* of the assist spring 50, 50*e* and the function of the position limiting portion 80*i*. Even with this configuration, the advantages, which are similar to those of the respective embodiments described above, can be achieved.

(6) The configuration of the valve timing adjusting device 100, 100*a*-100*f* of the respective embodiments described above is only an example and can be changed in various ways. For example, there may be provided a stopper that limits displacement of the assist spring 50, 50*e*, 50*f* toward the front cover 180 side in the axial direction AD. This stopper may be formed such that the stopper outwardly projects in the radial direction RD from the front cover 180 side end part of the bushing member 10, 10*a*, 10*c*, 10*e*. This stopper may be formed over the entire circumference of the bushing member 10, 10*a*, 10*c*, 10*e* or may be formed at only a part of the entire circumference of the bushing member 10, 10*a*, 10*c*, 10*e*. When this stopper contacts at least a portion of the front cover 180 side end surface of the assist spring 50, 50*e*, 50*f* in the axial direction AD, it is possible to further limit a reduction in the contact area between the assist spring 50, 50*e*, 50*f* and the bushing member 10, 10*a*, 10*c*, 10*e*. Furthermore, for example, the assist spring 50, 50*e*, 50*f* may urge the vane rotor 130 relative to the housing 120, 120*a* in the retarding direction instead of the advancing direction. Furthermore, for example, in place of the center bolt 190, the hydraulic oil control valve 350 may be placed along the rotational axis AX of the valve timing adjusting device 100, 100*a*-100*f*. Furthermore, the valve timing adjusting device 100, 100*a*-100*f* is configured to adjust the valve timing of the exhaust valves which are driven to open and close by the camshaft 320. Alternatively, the valve timing adjusting device 100, 100*a*-100*f* may be configured to adjust a valve timing of the intake valves. Furthermore, the valve timing adjusting device 100, 100*a*-100*f* may be used such that the valve timing adjusting device 100, 100*a*-100*f* is fixed to the end portion of the camshaft (serving as the driven shaft) 320 that receives the drive force from the crankshaft (serving as the drive shaft) 310 through an intermediate shaft. Alternatively, the valve timing adjusting device 100, 100*a*-100*f* may be used such that the valve timing adjusting device 100, 100*a*-100*f* is installed to an end portion of one of a drive shaft and a driven shaft of a dual structure camshaft.

The present disclosure is not limited to the above-described embodiments and can be realized in various configurations without departing from the principle of the present disclosure. For example, the technical features of each embodiment, which corresponds to the technical features in the summary section of the present disclosure, may be replaced or combined as appropriate to address some or all of the disadvantages described above or to achieve some or all of the advantages described above. If the technical feature(s) is not described as essential in the specification, it can be deleted as appropriate.

What is claimed is:

1. A valve timing adjusting device to be installed to an end portion of a driven shaft located at an end of the driven shaft in an axial direction, wherein the driven shaft is configured to receive a drive force transmitted from a drive shaft at an internal combustion engine, and the valve timing adjusting device is configured to use a hydraulic pressure to adjust a valve timing of a valve that is driven to open and close by the driven shaft, the valve timing adjusting device comprising:

a housing that is configured to be rotated synchronously with the drive shaft;

a vane rotor that is received in an inside of the housing and partitions the inside of the housing into a plurality of hydraulic chambers, wherein the vane rotor is configured to be rotated synchronously with the driven shaft;

an assist spring that is configured to urge the vane rotor in an advancing direction or a retarding direction relative to the housing, wherein the assist spring includes:

a coiled segment;

an inner end segment which is joined to one end of the coiled segment and inwardly projects in a radial direction; and an outer end segment which is joined to another end of the coiled segment and outwardly projects in the radial direction; and a bushing member that is fixed to the vane rotor, wherein:

the bushing member is shaped in a stepped cylindrical tubular form and includes:

a large diameter portion which is shaped in a cylindrical tubular form and is placed on a radially inner side of the coiled segment, wherein the large diameter portion includes a straight portion which is located at a radially outer surface of the large diameter portion and extends in the axial direction; and a small diameter portion which is shaped in a cylindrical tubular form and is connected to the large diameter portion on one axial side of the large diameter portion where the driven shaft is placed, wherein the small diameter portion is placed on a radially inner side of the housing and has an outer diameter that is smaller than an outer diameter of the large diameter portion;

the coiled segment includes a contact portion that is located at a radially inner surface of the coiled segment and is configured to contact the straight portion; and in the axial direction, a location of an end of the straight portion, which is located on the one axial side where the driven shaft is placed, coincides with a location of an end of the contact portion located on the one axial side, or is on the one axial side of the location of the end of the contact portion.

2. The valve timing adjusting device according to claim 1, further comprising a position limiting portion that is configured to limit a position of the assist spring relative to the bushing member in the axial direction.

3. The valve timing adjusting device according to claim 2, wherein the position limiting portion axially projects at the housing toward another axial side opposite to the driven shaft and contacts at least a portion of an end surface of the assist spring located on the one axial side where the driven shaft is placed.

4. The valve timing adjusting device according to claim 2, wherein the position limiting portion is radially inwardly recessed at the radially outer surface of the large diameter portion and contacts an end surface of the inner end segment located on the one axial side where the driven shaft is placed.

5. The valve timing adjusting device according to claim 2, wherein:

the position limiting portion is formed by an intervening member; and one surface of the position limiting portion located on the one axial side contacts the housing, and another surface of the position limiting portion located on another axial side opposite to the driven shaft contacts at least a portion of an end surface of the assist spring located on the one axial side where the driven shaft is placed.

6. The valve timing adjusting device according to claim 2, wherein the position limiting portion radially outwardly projects at the large diameter portion and contacts at least a portion of an end surface of the assist spring located on the one axial side where the driven shaft is placed.

7. The valve timing adjusting device according to claim 2, further comprising a retainer pin that is inserted into an insertion hole of the housing extending in the axial direction and is configured to retain the outer end segment, wherein the position limiting portion is formed by an enlarged diameter portion of the retainer pin that has an outer diameter larger than an outer diameter of a rest of the retainer pin and contacts an end surface of the assist spring located on the one axial side where the driven shaft is placed.

8. The valve timing adjusting device according to claim 1, wherein the assist spring is formed by a wire that has a circular cross-section.

9. The valve timing adjusting device according to claim 8, wherein a radius of the wire is larger than a dimension measured in the axial direction between the end of the straight portion, which is located on the one axial side where the driven shaft is placed, and the housing.

10. The valve timing adjusting device according to claim 2, wherein the assist spring is made from a wire that has a rectangular cross-section.

11. The valve timing adjusting device according to claim 1, wherein in the axial direction, the outer end segment is located on the one axial side of the inner end segment where the driven shaft is placed.

12. The valve timing adjusting device according to claim 1, wherein in the axial direction, the inner end segment is located on the one axial side of the outer end segment where the driven shaft is placed.

* * * * *